US008965568B2

(12) United States Patent
Geserich

(10) Patent No.: US 8,965,568 B2
(45) Date of Patent: Feb. 24, 2015

(54) FEED STATION FOR FEEDING FLAT ITEMS TO A PROCESSING APPARATUS

(71) Applicant: Frank Geserich, Friedrichsthal (DE)

(72) Inventor: Frank Geserich, Friedrichsthal (DE)

(73) Assignee: Francotyp-Postalia GmbH, Birkenwerder (DE)

( * ) Notice: Subject to any disclaimer, the term of this patent is extended or adjusted under 35 U.S.C. 154(b) by 0 days.

(21) Appl. No.: 14/099,117

(22) Filed: Dec. 6, 2013

(65) Prior Publication Data

US 2014/0163723 A1 Jun. 12, 2014

(30) Foreign Application Priority Data

Dec. 7, 2012 (DE) ..... 20 2012 011 877 U

(51) Int. Cl.

| | |
|---|---|
| ***G06F 7/00*** | (2006.01) |
| ***B65H 7/06*** | (2006.01) |
| ***B65H 7/18*** | (2006.01) |
| ***B65H 3/06*** | (2006.01) |

(52) U.S. Cl.

CPC .. *B65H 7/06* (2013.01); *B65H 7/18* (2013.01); *B65H 3/063* (2013.01); *B65H 2511/11* (2013.01); *B65H 2513/512* (2013.01); *B65H 2701/1916* (2013.01); *B65H 2513/10* (2013.01); *B65H 2553/82* (2013.01); *B65H 2701/1311* (2013.01); *B65H 2701/1313* (2013.01)

USPC ..... 700/230; 700/28; 271/34; 271/125; 271/258.01; 271/10.01

(58) Field of Classification Search

USPC ..... 700/230

See application file for complete search history.

(56) References Cited

U.S. PATENT DOCUMENTS

| | | | | |
|---|---|---|---|---|
| 6,241,235 | B1 * | 6/2001 | Schmidt-Kretschmer | 271/2 |
| 7,832,721 | B2 | 11/2010 | Kutzer et al. | |
| 2002/0140158 | A1 * | 10/2002 | Jaeger et al. | 271/125 |
| 2003/0168798 | A1 * | 9/2003 | Tufekci et al. | 271/258.01 |
| 2004/0056410 | A1 * | 3/2004 | Skadow et al. | 271/10.01 |
| 2007/0252321 | A1 * | 11/2007 | Kutzer et al. | 271/34 |
| 2008/0208370 | A1 * | 8/2008 | Bowers et al. | 700/28 |
| 2010/0001455 | A1 * | 1/2010 | Miwa et al. | 271/110 |
| 2013/0221606 | A1 * | 8/2013 | Lai et al. | 271/34 |

FOREIGN PATENT DOCUMENTS

| | | |
|---|---|---|
| DE | 101 27 993 | 12/2002 |

* cited by examiner

*Primary Examiner* — Gene Crawford
*Assistant Examiner* — Kyle Logan
(74) *Attorney, Agent, or Firm* — Schiff Hardin LLP

(57) ABSTRACT

A feed station has a pre-separation region, a separation region and a transport region in succession along a transport path. A first sensor is at the start of the separation region and a second sensor is at the start of the transport region. A control unit processes signals from the sensors and encoders to determine the position of the flat item, and is connected with a separation motor to drive the separation device, so that a flat item is separated from a stack with a predetermined separation velocity. If unacceptably small gaps exist between the flat items, the separation process is stopped when the leading edge of a subsequent flat item reaches the second sensor and is continued when the preceding separated flat item achieves a predetermined clearance from the leading edge of the aforementioned flat item due to its transport.

11 Claims, 13 Drawing Sheets

FEED STATION FOR FEEDING FLAT ITEMS TO A PROCESSING APPARATUS

BACKGROUND OF THE INVENTION

1. Field of the Invention

The invention concerns a feed station to feed a flat item which is fed individually or from a stack to a subsequent processing apparatus for the items. Such a flat item can be a thin mail piece such as postcards, "normal" mail goods of medium thickness (for example the standard letter in Germany) and thick mail pieces (for example the compact letter in Germany). The feed station has a controller that controls the feed so that a high throughput is achieved. The processor of the controller allows a selected mode of operation to be detected. Such a feed station can be used in connection with franking machines, addressing machines and other mail processing apparatuses.

2. Description of the Prior Art

Feeds of many different types are known in which the drive elements are mechanically coupled. Especially for short items, i.e. letters or mail pieces having a short format, the separation drive impresses a drive force on a subsequent item that follows a current item (i.e. letter or mail piece) very early so that items (i.e. letters or mail pieces) are separated (isolated) without large gaps there between or with insufficient gaps. Moreover, there is no possibility to vary these gaps within the feed.

A known separation device has two separation rollers and a transport device with one roller, with the rollers all permanently kinematically coupled with one another. A sluice of the separation device is formed by a gap between the second separation roller and by a number of fingers at the head of a rocker. The gap has dimensions that correspond to a width and a height of filled, commercially available letter envelopes. A stack of mail pieces is placed on the first separation roller. As soon as the first separation roller releases the lowermost mail piece of the stack via its rotation, a transport force is immediately impressed by the first separation roller on a respective second lowermost mail piece. This can lead to separation errors. In the most advantageous case, the advance of the second mail piece is stopped by the sluice of the separation device but represents a potential error source and unnecessary loading of the separation. Different formats likewise have an influence on the separation. Although the separation device can be adapted to other formats via a mechanical displacement or, respectively, adjustment, an automatic adaptation is not possible. Due to the lack of an additional sensor, no letter length measurement (and thus also no different control for different letter lengths) is possible. Additional disadvantages of the aforementioned separation device are that no gap measurement (and thus also no optimization of the gap), occurs, so that no error detection in the feed station is possible. The fixed kinematic coupling of the drive rollers does not allow a coordination of the separation velocity and/or the transport velocity, or a gap adjustment.

A franking system from Francotyp-Postalia GmbH has a feed station with a separation device and with a transport device, wherein—in the mail transport path—the feed station is arranged upstream in terms of mail flow of an Ultimail®-type franking machine. The separation device of the feed station has a transport belt in the pre-separation region. A drive drives the transport belt and the transport device, which are coupled with one another in terms of actuation. An additional drive acts on a separation roller. The sluice of the separation device is formed by a gap between the separation roller and by a number of fingers at the head of a rocker, which are arranged over the separation roller. It has been empirically established that the requirements for the reliability of the separation given a high throughput of flat items are satisfied with a high certainty only for a narrow spectrum (for example a defined type) of stacked mail goods. A sloped housing before the gap leads through a continuous tapering in the input region to the compression of the goods in the stack. Thick mail pieces cannot be separated from the stack if the gap through which a mail piece is sluiced has been set to be too narrow. However, if the gap has been set too wide, errors occur in the separation, in particular given a high throughput of flat items. The throughput likewise turns out to be less than possible due to large gaps between the successive mail pieces, in particular given short mail pieces (postcards, for example). The transport device has a closing device for open envelopes, which closing device is arranged between two transport rollers. An actuation device with a sealer button can bring the device into an operating position. In the operating position, an unsealed flap is raised from the envelope by a blade, moistened, and subsequently pressed onto the envelope by means of the second transport roller. As soon as the lowermost mail piece releases the first separation roller via rotation of the transport belt, a transport force is impressed by the first separation roller on a respective second mail piece. This can likewise lead to separation errors. The surface friction value of the transport belt must be very exactly matched to the mail piece surface so that a propulsive force that is too strong is not impressed on the respective second lowermost mail piece of the stack. The reliability of the separation would be increased if a propulsive force acts only on the mail piece that should be separated and supplied.

A separation device is known for flat articles is known from DE10127993A1, which separation device has a feed belt on driven deflection rollers and retention means, wherein in the latter a separation element is included which with the feed belt forms a sluice via which the separated flat articles are transported along the entire length. The feed belt is designed as a segmented belt that has a pull-in segment and a sliding segment. Upon placement of a mail piece or stack of mail pieces, a first and a second motor are automatically activated by a controller when a first sensor detects the placement. The stack is transported to the retention means of the separation means as soon as the first motor is activated. The stack is separated by the lowermost mail piece being removed, and the second motor is controlled accordingly by the controller. An encoder electrically connected with the controller serves for the detection of the positioned reached by the pull-in segment and (via the controller) secures the rotation speed constant of the second drive upon separation. The flat article can be pulled out from the separation device by the driving of the rollers of an ejection device via a third motor and can subsequently be ejected from the separation device, wherein the third motor is controlled by the controller. In spite of a significant cost in motors, sensors and mechanical components, the separation device does not allow a predetermined gap to be maintained between successive flat articles, in particular mail pieces with varying thickness and given the same format.

SUMMARY OF THE INVENTION

An object of the invention is to remedy the deficiencies of the above-described known apparatuses. An automatic feed for a flat item should be developed that, with at most two separate drives, achieves a very reliable separation and offers a high degree of flexibility for the control with regard to throughput, processing of the different mail piece formats and thicknesses and with regard to the adjustment of defined gaps between the successive mail pieces.

In accordance with the invention, the feed station has a pre-separation region, a separation region and a transport region, with the transport region arranged on a transport path after the separation region in the transport direction. The feed station serves to feed a flat item which is supplied individually, or separated from a stack, to a subsequent goods processing apparatus. The separation region is a segment of the transport path—situated between a first separation roller and a second separation roller of a separation device—on a feed deck and is composed of multiple stages.

A first sensor is arranged at the start of the separation region and detects a stack or a single flat item placed in the pre-separation region at the feed station. A second sensor is arranged at the start of the transport region. The sensors are arranged one after another on in the transport direction on the transport path. The feed station comprises motors with associated encoders, additional mechanical drive elements, sensors and a control unit which is electrically connected (in terms of a circuit) at its inputs with a number of sensors and encoders. The control unit has a processor, a signal processing means for the signals of the sensors and the encoder, and a determination means to determine the position the flat item.

A processor of the control unit is programmed by an application program stored in a program memory so that the control unit is controlled by a first motor to drive a separation device in the separation region of the feed station so that a flat item is separated with a predetermined separation velocity from a stack placed at the feed station. The first motor is designated as a separation motor. Given a gap that is too small, the separation process is stopped between the flat items as soon as the leading edge of a subsequent flat item reaches the region of the second sensor and continues when the preceding separated flat item reaches (via its transport) a predetermined clearance from the leading edge of the aforementioned flat item. The predetermined clearance is a distance that produces a temporal distance between the flat items in immediate succession. The separation velocity is predetermined automatically as a discrete desired value for the digital speed regulation, depending on the measured length of a preceding separated flat item. Controlled by a program, the control unit can on the other hand control a second motor to drive a transport device in the transport region of the feed station so that a separated flat item is transported downstream (in terms of the mail flow) and is supplied to a subsequent mail processing device with a predetermined transport velocity. The second motor is designated in the following as a transport motor. The transport velocity is varied automatically before the feed depending on the stored data of a preceding separated flat item and on the position of the current flat item to be separated, such that too large a gap between the goods is reduced and a predetermined throughput of flat items results. A memory means is provided for the automatically determined input variables and for the additional input variables input by hand. The separation velocity and the transport velocity can thereby be varied even further in order to also increase the certainty of separation if the feed station should satisfy additional functions. Particularly thick mail pieces can thus be processed. A closing device for mail pieces has also been into the transport region of the feed station in order to moisten the open flap of a filled envelope and close it. This auxiliary function is input manually. The control is based on a number of suitable desired velocity values or, respectively, machine-specific path and/or time values for the separation and transport of a flat item which have been determined empirically and are applied depending on position. The feed operation has thereby been modified so that the reliability of the separation is increased.

Whether a stack is present upstream (in terms of the mail flow) in the pre-separation region at the feed station is detected by the first sensor. A flat item or mail piece situated all the way at the bottom of the stack is respectively isolated first and is subsequently removed from the stack. The separation process is stopped as soon as the leading edge of a subsequent mail piece reaches the region of a second sensor. A flat item or mail piece that follows immediately in the stack can therefore not already be separated as long as the separation process is stopped. The separation process is continued if the preceding separating flat item reaches a predetermined clearance from the leading edge of the aforementioned mail piece via its transport in the transport region. The separation velocity of the mail piece that follows immediately in the stack is automatically controlled at a predetermined desired value based on a measured length of the respective first removed mail piece of a stack of mail pieces with the same format. The mail processing apparatus is advantageously a franking machine which is arranged downstream (in terms of the mail flow) of the feed station. The franking machine has input means for a mode selection and is connected in terms of communication with the feed station. Via an input actuator (seal button), the feed station allows a selection of operating mode between a seal operation and a non-seal operation of the closing device of the feed station. With this information, and via the aforementioned automatic length measurement, input variables are provided for the control unit of the feed station to adapt the feed operation to the current separation and feed task. The automatic feed station has two drive motors with a respective associated encoder, additional mechanical actuation elements, sensors and a control unit. The lowermost good or mail piece is respectively separated from a stack by a separation device and transported furthermore by a subsequently arranged transport device. The separation region is arranged at a segment situated between a first separation roller and a second separation roller and is made up of multiple stages. A discontinuous tapering in the input region is therefore achieved, which advantageously does not lead to the compression of the goods. A respective encoder is arranged on the axle shaft of the separation motor or, respectively, of the transport motor. The separation device also comprises a first sensor device and a first actuation device, wherein the separation motor is kinematically coupled via the first actuation device with the first and second separation roller for their rotation, wherein the first sensor device comprises a mount situated at an angle that is designed for attachment of the first sensor, which detects (with a light traveling at a slant with an angle $\alpha$ relative to the transport direction in a region before the first separation roller) as soon as a flat item is placed at the feed station. The transport device likewise comprises a transport motor, an encoder, a second drive device and a second and third sensor device, wherein the transport motor is kinematically coupled via the second actuation device with the first and second transport roller for their rotation. The second sensor is arranged at the start of the transport region, and a third sensor is arranged in the transport region. The second and third sensor device are designed for attachment of one of the respective additional sensors, wherein the sensors are arranged one after another in the transport direction of the flat item and are provided to detect the dimension and position of the flat item in the transport path. The feed station has a control unit which is designed for communication with a subsequent item-processing apparatus via which the inputs can also be made. The control unit is connected at least with the sensors and encoders to receive a signal and with the motors to control them. Each of the sensor devices has mounts for light sources and light collectors of a photoelectric barrier. For example, the latter are designed as transmitted photoelectric barriers, for example, and are arranged in the transport path and connected with the control unit which controls the motors. The separation rollers and transport rollers are equipped with a freewheel mechanism and arranged so as to be able to rotate within a U-shaped frame. The first actuation device for the separation rollers is arranged on the one side of the U-shaped frame, and the second actuation device for the separation rollers is arranged on the other side of the U-shaped frame. A respective encoder is arranged on the axle shaft of the separation motor or transport motor, wherein encoder pulses are transmitted to the control unit.

Advantageously, only two separate drives and three sensors are required in order to control the speed of the drive motors, such that a high throughput of flat items results with greater separation reliability. The separation motor is a first direct current motor that is controlled via the control unit so that, in the standard mode, a first predetermined separation velocity is achieved given at least one first flat item removed from the stack. The transport motor is a second direct current motor that is controlled by the control unit so that, in the standard motor, a first predetermined transport velocity is achieved at least given a flat item removed from the stack, wherein the transport velocity is greater than the separation velocity. The length of the transported flat item is determined by the control unit using the number of encoder pulses, wherein a second predetermined separation velocity is predetermined automatically for each additional flat item removed from the stack, if the length of the transported flat item does not fall below a first length value. A third predetermined separation velocity is predetermined for each flat item removed from the stack when a switching of the feed station to a thickness mode has taken place in the subsequent goods processing apparatus. The second predetermined separation velocity is greater than the first predetermined separation velocity and less than the third predetermined separation velocity. The third predetermined separation velocity is less than the first predetermined transport velocity.

Via the separate drives and sensors, various workflow controls can be realized, wherein at least one workflow control is provided by an operating mode of the feed station that is selected via an input unit of the franking machine. Different throughputs per minute and clearances between the goods or, respectively, mail pieces can therefore be realized. Otherwise—if a defined workflow control has not been set—a standard setting is selected automatically.

DESCRIPTION OF THE PREFERRED EMBODIMENTS

Figure 1:
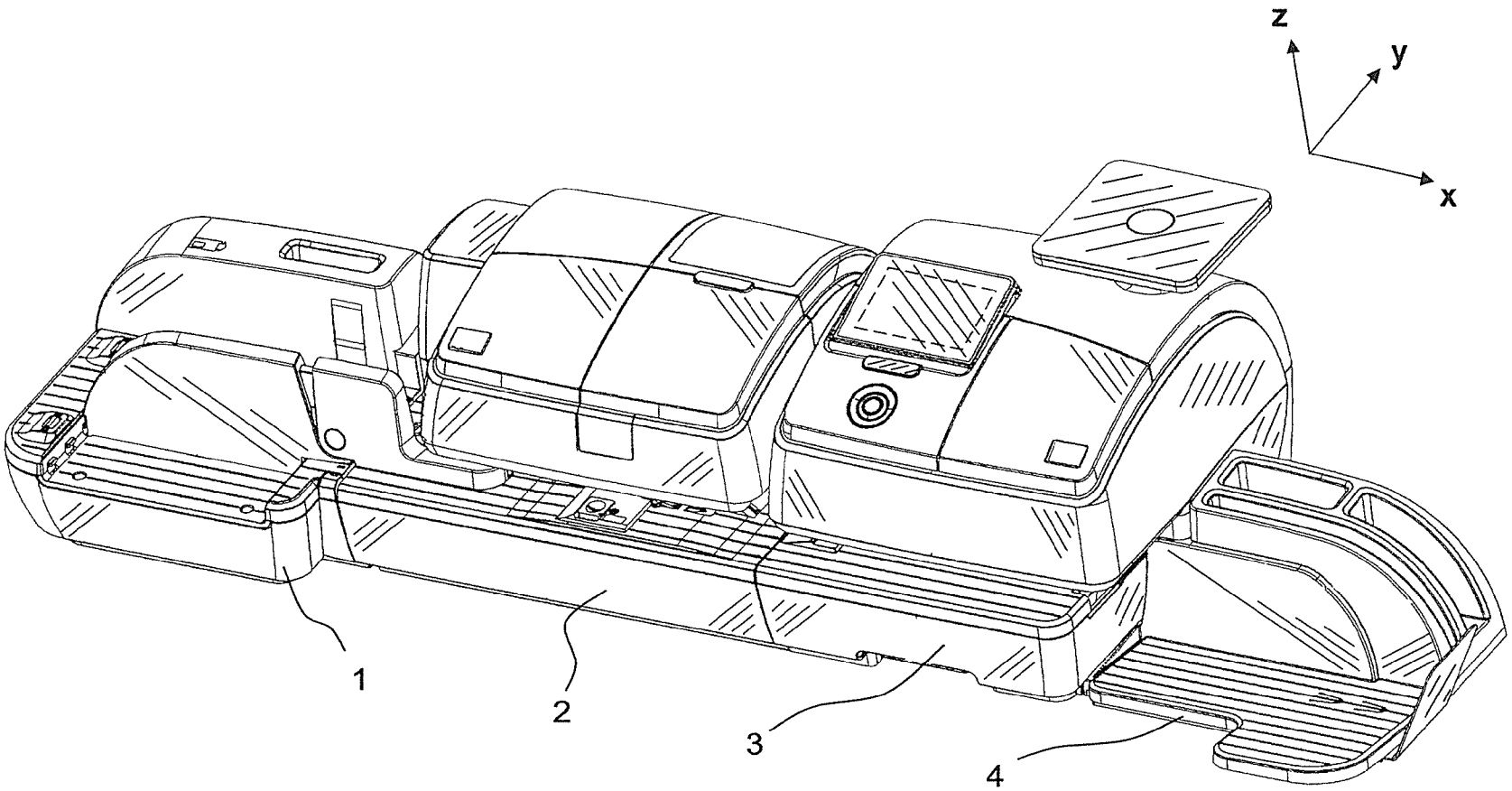
FIG. 1 is a perspective view of a mail processing system with a modular placement device, with a feed station, with a franking machine and with a stacking device.

FIG. 1 shows a perspective view of a mail processing system, with a modular placement device 1, with a feed station 2, with a franking machine, 3 and with a stacking device 4, in a view from the upper right front. The transport direction is the x-direction of a Cartesian coordinate system whose y-direction points towards the back side of the apparatuses of the system and whose z-direction points upward.

Figure 2:
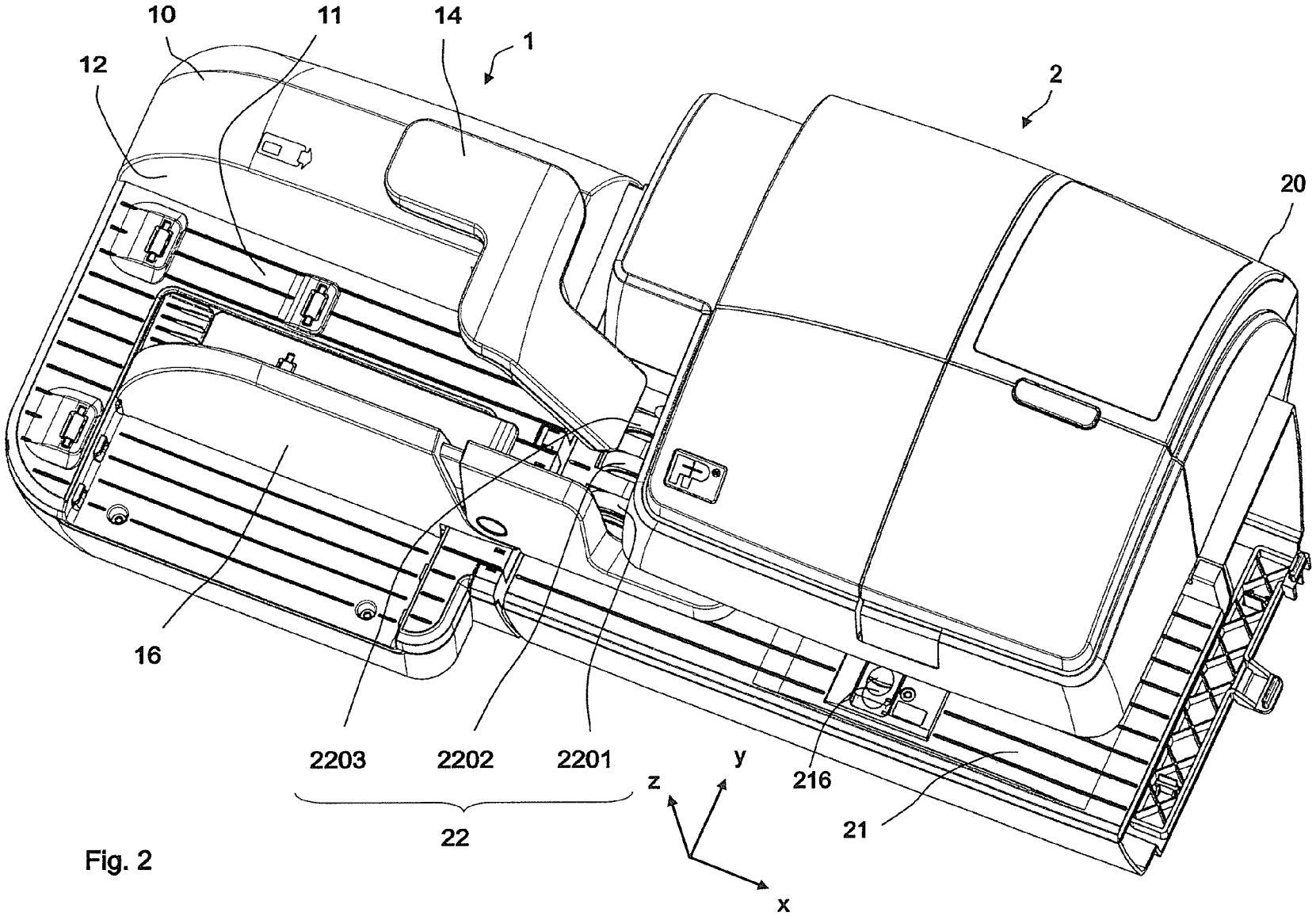
FIG. 2 shows the feed station with a modular placement device.

A feed station with a modular placement device is shown FIG. 2, with a view from the upper right front. The placement device 1 has a housing 10 with a feed deck 11, a guide wall 12 and a slider 16. With the latter, mail pieces or stacks of mail pieces of the same format can be slid against the guide wall 12. A placement element 16 presses from above onto the stack (not shown) in the event that a stack is placed. A placed stack would rest on the three rubber wheels 2201, 2202 and 2203 of a first separation roller 22 of the feed station 2, which separates mail pieces from the stack and slides them onto the feed deck 21. The feed deck 21 has a seal button 216 that is arranged on the front side of the apparatus. The mechanical design of the feed station 2 below the housing 20 is explained in more detail in the following.

Figure 3A:
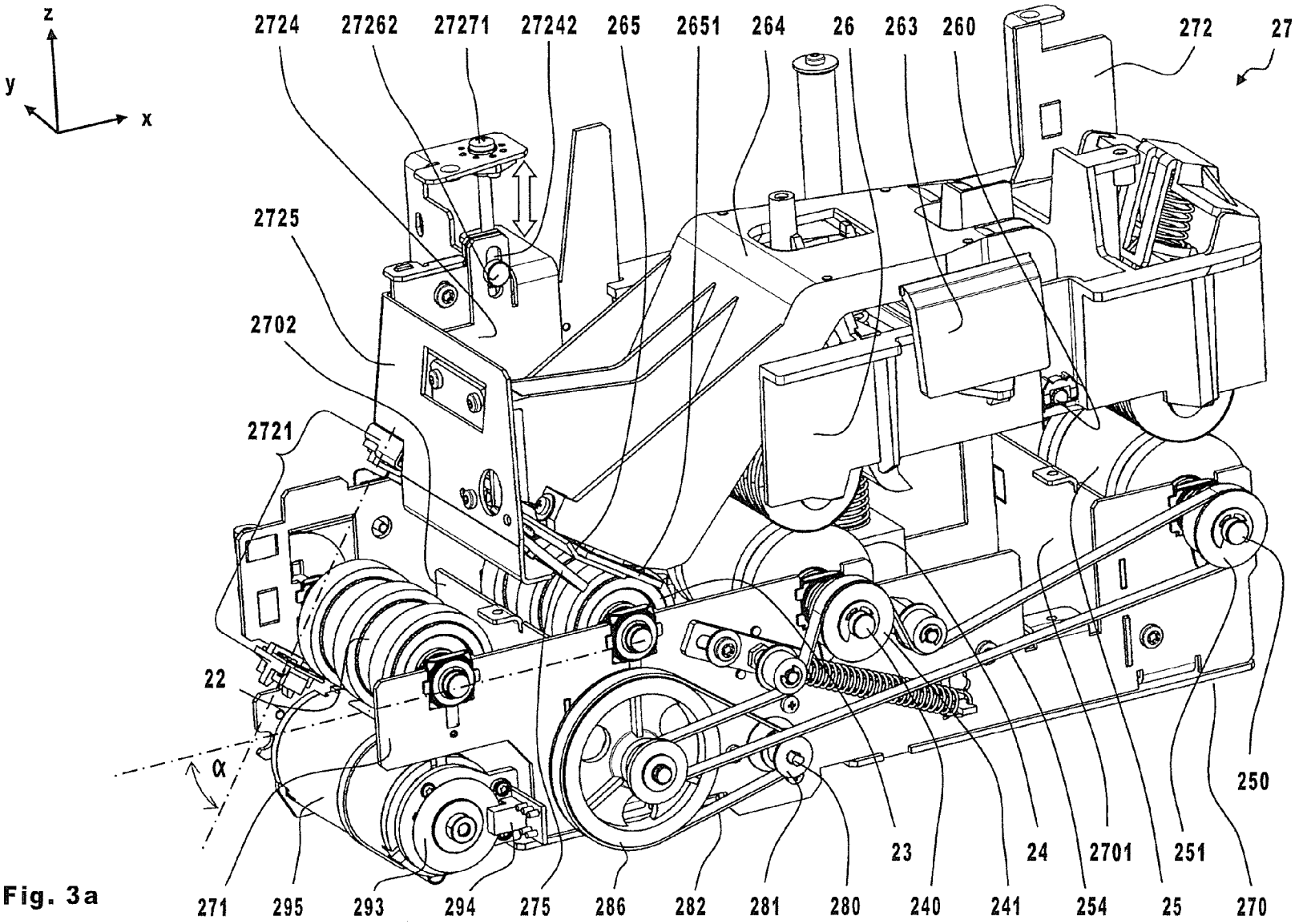
FIG. 3*a* is a perspective view of the mechanical design of the feed station with a pressure box in the operating position, as seen from the upper front left.

The mechanical design of the feed station with a pressure box in the operating position is shown in perspective in FIG. 3*a*, with a view from the upper front left. A frame 27 has a front frame wall 271 and a rear frame wall 272 that both extend in the x-direction and are standing on a floor plate 270 and are separated from one another in the y-direction by two transverse walls 2701 and 2702. The first separation roller 22 is arranged at the input side (in terms of the mail flow) before the second transversal wall 2702 and is mounted between the front frame wall 271 and the rear frame wall 272 so that it can rotated. A first sensor device 2721 is designed for attachment of a first sensor which scans a region before the first separation roller 22 at an incline (i.e. at an angle $\alpha$ relative to the transport direction) for whether a flat item or, respectively, a stack is present at the feed station.

A pressure box 26 is arranged at the rear frame wall 272 so as to be displaceable, which pressure box 26 supports a rocker 264 that is borne so as to be able to rotate on a rotation shaft 260. The rotation shaft 260 lies parallel to the y-direction. The pressure box 26 is shifted in the z-direction via elastic force when a stop [an arresting] is triggered by pressing a button 263. The rocker 264 bears at its head a stop plate 265 arranged so as to be adjustable. A rubber mat with four separation fingers 2651-2654 is squeezed between the stop plate 265 and the rocker head, wherein in this presentation the separation fingers 2652-2654 are occluded by the rocker head. The rocker head is drawn via an elastic force (FIG. 3*f*) towards a second separation roller 23 of the feed station. The second separation roller 23 is arranged at a distance in the x-direction (i.e. in the transport direction) from the first separation roller 22 of the feed station. The separation already begins at the pre-separation plate 2725 which is attached to the rear frame wall 272 and arranged transversal to this, and before the rocker head. At least one pre-separation finger 275 is attached at the pre-separation plate 2725 and arranged so that the separation fingers 265 are adjacent and situated in the transport direction. Moreover, means 2724, 27242, 27262 and 27271 are shown that are provided for adjustment of a stop of the rocker head and are explained in detail further below using following Figures. In the adjustment, the rocker head is moved in the arrow direction of the white arrow. Both separation rollers 22 and 23 of the feed station are driven by a first direct current motor 295 via a mechanism (occluded in the presentation) of a first actuation device. An encoder wheel 293 which is scanned (sampled or polled) by an encoder electronic unit 294 is arranged on the motor axle shaft. The first drive device is explained in detail further below using following Figures. A second drive device has a toothed roller 281 that is installed on a motor axle shaft 280 of a second direct current motor (occluded in the presentation), on which a first toothed [synchronous] belt 282 that drives a reducing gear 286. A second toothed belt 254 likewise runs on the reducing gear 286. It drives the toothed rollers 241 and 251 of two transport rollers 24 and 25, wherein the toothed rollers 241 and 251 are mounted so as to be able to rotate on rotation axle shafts 240 and 250, and the transport rollers 24 and 25 are co-rotationally connected with the rotation axle shafts 240 and 250. The toothed rollers 241 or 251 or the transport rollers 24 and 25 are internally equipped with a freewheel mechanism, wherein the freewheel is active in the x-direction.

Figure 3B:
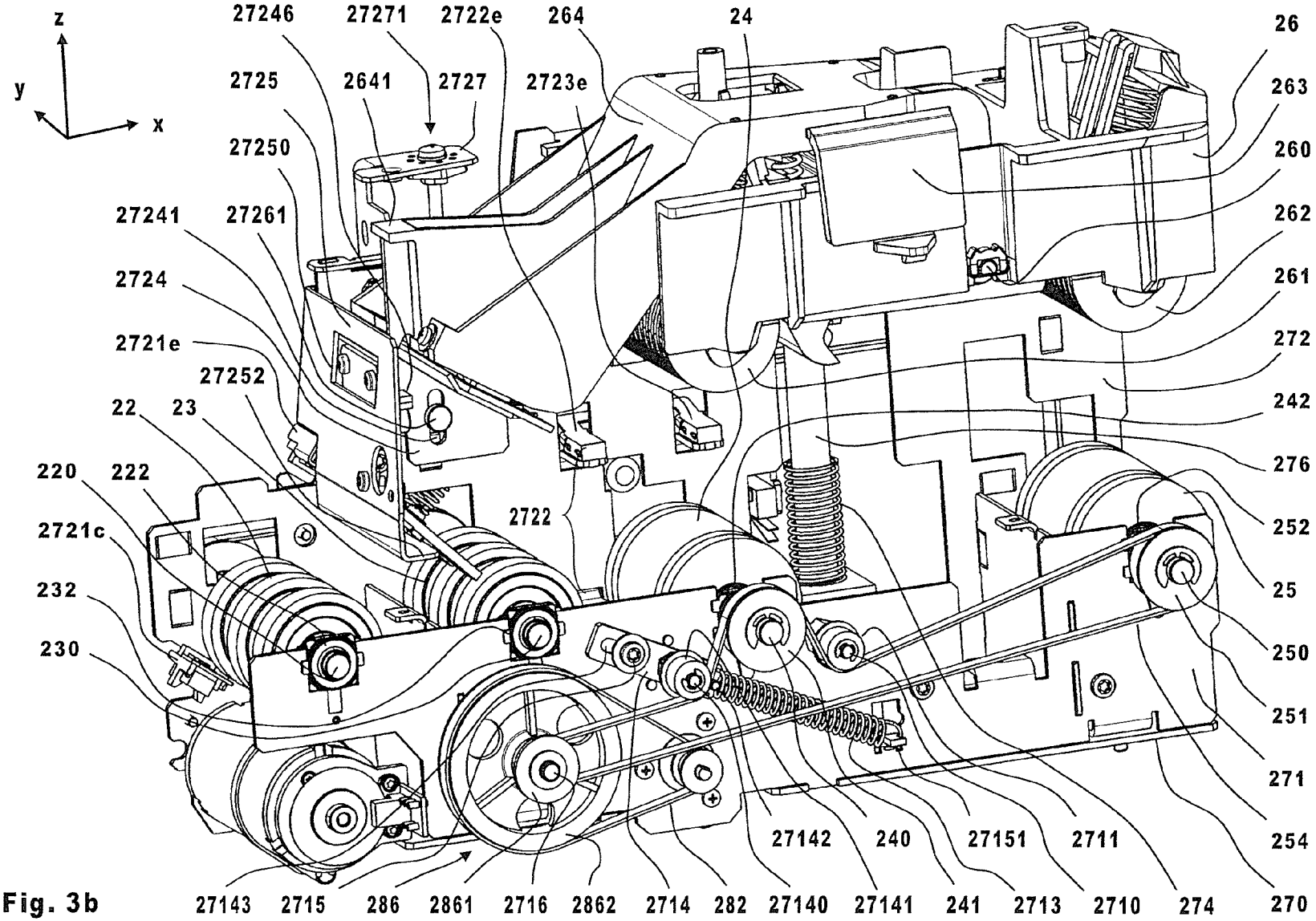
FIG. 3*b* is a perspective view of the mechanical design of the feed station with a pressure box in the service position, as seen from the upper front left.

FIG. 3*b* shows a perspective presentation of the mechanical design of the feed station with a pressure box in the service position, from the upper front left. The service position enables a good access to the transport path for the purpose of service or for correcting a jam given a jam of mail pieces. A compression spring 274 placed on a guide rod 276 moves the pressure box 26 in the z-direction as soon as the stop is triggered by operation of the button 263. The rocker 264 is borne so as to be moveable on the axle shaft 260 and has the aforementioned stop 2641 at the rocker head. The pressure rollers 261, 262 are borne elastically in the pressure box 26 so as to be able to rotate. The guide rod 276 is attached to the frame floor 270. Of the components shown in FIG. 3*a* that are provided for adjustment of a stop of the rocker head, the stop support plate 2724 and the adjustment screw 27271, as well as an angle plate 2727, are visible in FIG. 3*b*. The angle plate 2727 is firmly attached to the rear frame wall 272, which likewise arises from FIG. 3*c*. A rotation on the adjustment screw 2721 produces an up-and-down movement of the stop support plate 2724 in the z-direction. The stop support plate 2724 has an oblong hole 27241 as a guide in the z-direction which is arranged vertically below the occluded oblong hole 27242 (which is, however, visible in FIG. 3*a*). Two screws 27261 (visible) and 27262 (occluded) plug into these oblong holes, which two screws are installed on the front side of the rear frame wall 272. An angle plate bent at a right angle from the stop support plate 2724 arises from FIG. 3*f*, which angle plate has a an angled stop piece, wherein the latter has at least one rubber stop cushion 27246. The rubber stop cushion 27246 comes into contact with the stop 2641 of the rocker 26 when the pressure box has been moved back into the operating position. Adjustment and attachment means of a roller support plate are installed on the angle plate, which adjustment and attachment means are accessible via a rectangular first adjustment opening 27250 in the pre-separation plate 2725. The latter transitions at the lower edge into a stage 27252 bent in the transport direction. In the pre-separation plate, near the rear frame wall 272 an additional opening is made in which a mount 2721*e* of a first light emitter is installed. A mount 2721*c* of an associated first light collector is installed on the rear frame wall 272, before the first pre-separation roller 22. The first light emitter and the first light collector form a first photoelectric barrier. Both mounts are part of the first sensor device. A second sensor device 2722 is arranged immediately before the first transport roller 24 and a third (partially occluded) sensor device 2723 is arranged immediately after the first transport roller 24. A mount 2722*e* of a second light emitter is part of the second sensor device 2722. A mount 2722*e* of a second light emitter is part of the second sensor device 2722. A mount 2723*e* of a third light emitter is likewise part of the third sensor device 2723. Both sensor devices 2722, 2723 are not inclined, but rather are installed orthogonal to the transport direction on the rear frame wall 272. The two sensor devices 2722, 2723 can therefore be executed as a common module. The first pre-separation roller 22 and the second pre-separation roller 23 respectively have an axle shaft 220, 230 that respectively run in slide bearings 222, 232. The slide bearings 222, 232 are installed on the front frame wall 271. Slide bearings (not shown) in which the axle shafts 220, 230 travel are likewise installed on the rear frame wall 272. The left side of the feed station can be designated as a mail flow separation side. The axle shafts 240, 250 of the first transport roller 23 and the second transport roller 25 likewise respectively run in slide bearings 242, 252, wherein the latter cited slide bearings 242, 252 are installed on the front frame wall 271. Slide bearings (not visible in FIG. 3*b*) in which the axle shafts travel are likewise installed on the rear frame wall 272.

A large toothed roller 2862 is firmly connected with a small toothed roller 2861 of the reducing gear 286. Both are advantageously formed as a single module and plugged onto a common axle screw 2716 that is installed on the front side of the front frame wall 271. The first toothed belt 282 drives the large toothed roller 2862. The second toothed belt 264 of the second actuation device runs on the small toothed roller 2861 of the reducing gear 286, a second toothed roller 241 and third toothed roller 251. A first deflection roller 2711 is arranged next to the second toothed roller 241 in the transport direction and rotates on an axle bolt 2710 that is likewise installed on the front side of the front frame wall 271, but is arranged nearer the frame floor than the axle shaft 240. A deflection roller 27141 of a tensioning device is arranged between the second toothed roller 241 and the small toothed roller 2861 of the reducing gear 286. The deflection roller 27141 is mounted so as to be rotatable on an axle screw 27140 that is installed on a toothed belt tensioning plate 2714, near its end. Installed at its end is a first hook 27142 for a tension spring 2713 on the toothed belt tensioning plate 2714. A second hook 27151 for the tension spring 2713 is provided on the front side of the front frame wall 271. The second hook 27151 is separated from the first hook 27142 in the x-direction and z-direction. The tension spring 2713 is tensioned between the aforementioned two hooks, wherein a tensile force acts via the deflection roller 27141 of the tensioning device so that the second toothed belt 254 is stretched taut by the tensile force of the second toothed belt 254. An oblong hole 27143 is worked into the other end of the toothed belt tensioning plate 2714. Arranged therein is an adjustment screw 2715 that is installed on the front frame wall 271. The wrap arc of the second toothed roller 241 by the toothed belt is also increased via the deflection roller 2711 and the deflection roller 27141 of the tensioning device.

Figure 3C:
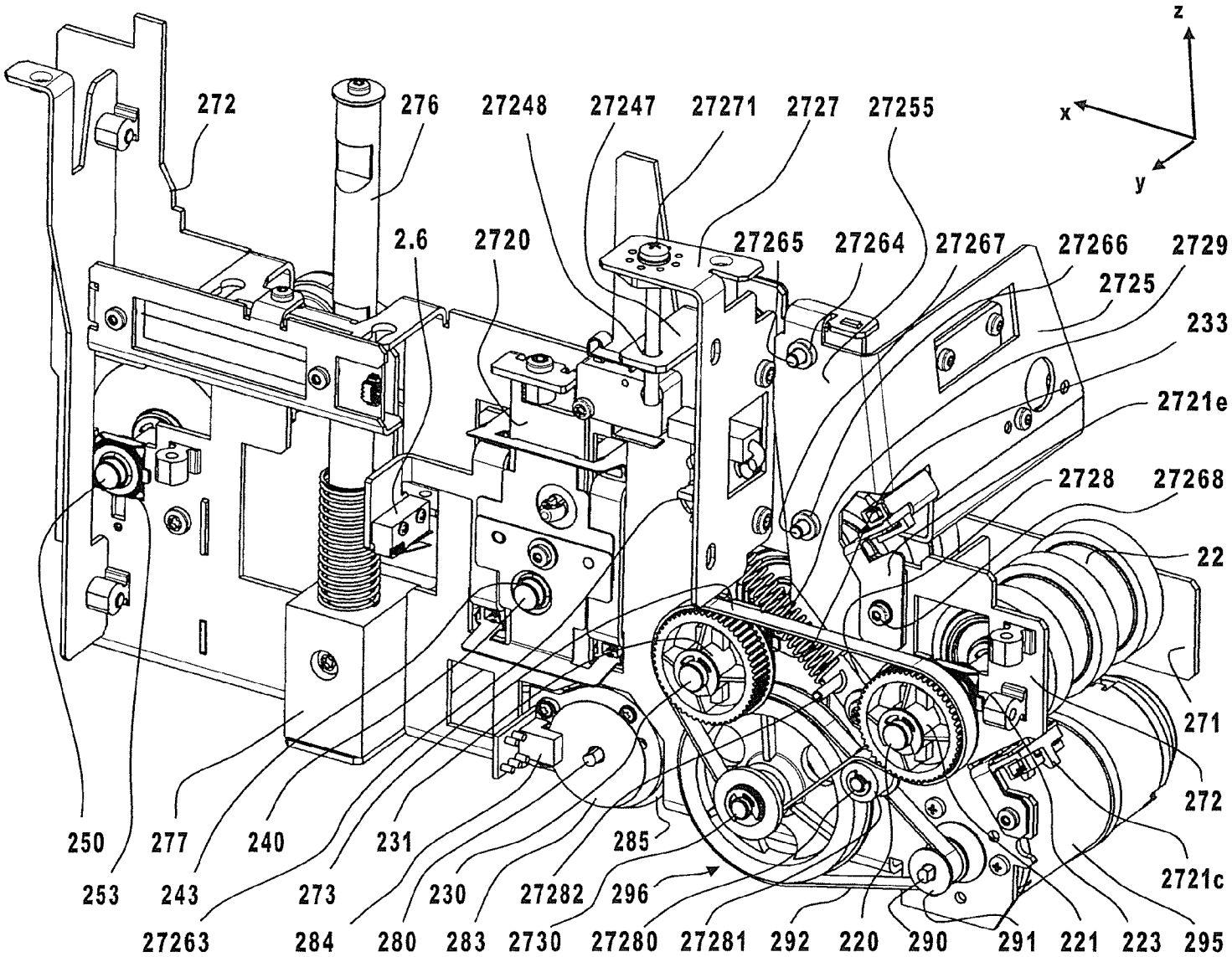
FIG. 3*c* is a perspective view of the mechanical design of the feed station without the pressure box.

FIG. 3*c* shows a perspective presentation of the mechanical design of the feed station without the pressure box, with a view of the mail flow separation side of the feed station from behind and above. The first separation roller 22 is arranged vertically above the direct current motor 295 in the frame on the mail flow separation side of the feed station, between the front frame wall 171 and the rear frame wall 172. The direct current motor 295 drives a mechanism of the first actuation device which has a reducing gear 296 that is arranged (in terms of drive force) between the direct current motor 295 and the first separation roller 22 and increases the separation force. The first actuation device furthermore comprises a first toothed roller 291 on which runs a first toothed belt 292 that drives a large toothed roller of the reducing gear 296. The toothed roller 291 is installed directly on the motor axle shaft 290 of the first direct current motor. The large toothed roller is firmly connected with a small toothed roller of the reducing gear 296. Both are advantageously formed as a single module and plugged onto a common axle screw 2730 that is installed on the back side of the rear frame wall 272. A second toothed belt 273 of the first actuation device runs on the small toothed roller of the reducing gear 296, a second toothed roller 221 and a third toothed roller 231. A deflection roller 27281 of a tensioning device is arranged between the second toothed roller 221 and the small toothed roller of the reducing gear 296. The deflection roller 27281 is borne so as to be able to rotate on an axle screw 27280 that is mounted on a toothed belt tensioning plate 2728 near one of its ends. Installed at its end is a first hook 27282 for a tension spring 2729 on the toothed belt tensioning plate 2728. A second hook 27263 for the tension spring 2729 is provided on the back side of the rear frame wall 272. The second hook 27263 is separated from the first hook 27282 in the x-direction and z-direction. The tension spring 2729 is tensioned between the aforementioned two hooks 27282 and 27263, wherein a tensile force acts via the deflection roller 27281 of the tensioning device so that the second toothed belt 273 is stretched taut by the tensile force. The toothed roller 221 or, respectively, 231 is firmly mounted on the rotation axle shaft 220 or, respectively, 230. The rotation axle shafts 220 and 230 of the first actuation device respectively run in slide bearings 223 and 233. Each of the slide bearings 223 and 233 is installed on the back side of the rear frame wall 272. The rotation axle shafts 240 and 250 of the second actuation device likewise run in respective slide bearings 243 and 253. Each of the slide bearings 243 and 253 is installed on the back side of the rear frame wall 272. Corresponding associated slide bearings are installed on the front frame wall 271, as arises from FIGS. 3*a* and *b*. On the back side of the rear frame wall 272, the guide rod 276 visibly projects upward (z-direction). An attachment block 277 of the guide rod 276 is installed on the frame floor. The attachment point is arranged (not visible) on the one hand in the region between the slide bearings 243 and 253, and on the other hand in the region between the transversal walls of the frame, as well as between the front frame wall 271 and the rear frame wall 272.

An encoder wheel 283 which is scanned by an electronic encoder 284 is arranged on the motor axle shaft 280 of the direct current motor 285 of the second actuation device. The elements of the second actuation device have essentially already been explained using FIGS. 3*a* and 3*b*. An angle plate 2727 at the rear frame wall 272 and the adjustment screw 27271 for height adjustment of the stop support plate have already been noted together with additional means that are provided to adjust a stop of the rocker head. An angle plate 27247 is bent in the y-direction at the upper edge of the stop support plate and bears a bore hole 27248 with an inner threading in which the adjustment screw 27271 can be turned. The stop support plate is moved via the turning. Attachment means 27264 through 27267 that serve for attachment of the pre-separation plate 2725 are provided on the rear frame wall 272. For this purpose the pre-separation plate 2725 is bent in the x-direction at the edge near the rear frame wall 272. The bent plate part 27255 lies on the back side of the rear frame wall and bears openings for the attachment means. For example, screws 27265 and 27267 (or alternatively bolts without threads or, respectively, rivets) can be used. In the case of screws 27265, 27267, nuts 27264, 27266 are used in order to attach the pre-separation plate 2725 to the rear frame wall 272. A locking screw 27268 is screwed into the back side of the rear frame wall in order to attach the mount 2721*e* of the first light emitter so that a light beam from the first light emitter can arrive at the first light collector that is attached to the mount 2721*c* if no flat item is present at the feed station. The mount 2721*c* is attached to the rear frame wall 272 in the same manner. Alternatively, a single module that comprises both mounts is provided for the first sensor device. A common module 2720 is already provided for the two sensor devices 2722, 2723, which common module 2720 is installed on the back side of the rear frame wall 272 and whose mounts for the individual sensor elements protrude forward through corresponding openings of the rear frame wall 272 to the transport path. The common module 2720 has a plate part that transitions into an arm that extends in the transport direction (x-direction) and is bent at its end in the y-direction. The arm bears a microswitch 2.6 at its bent end.

Figure 3D:
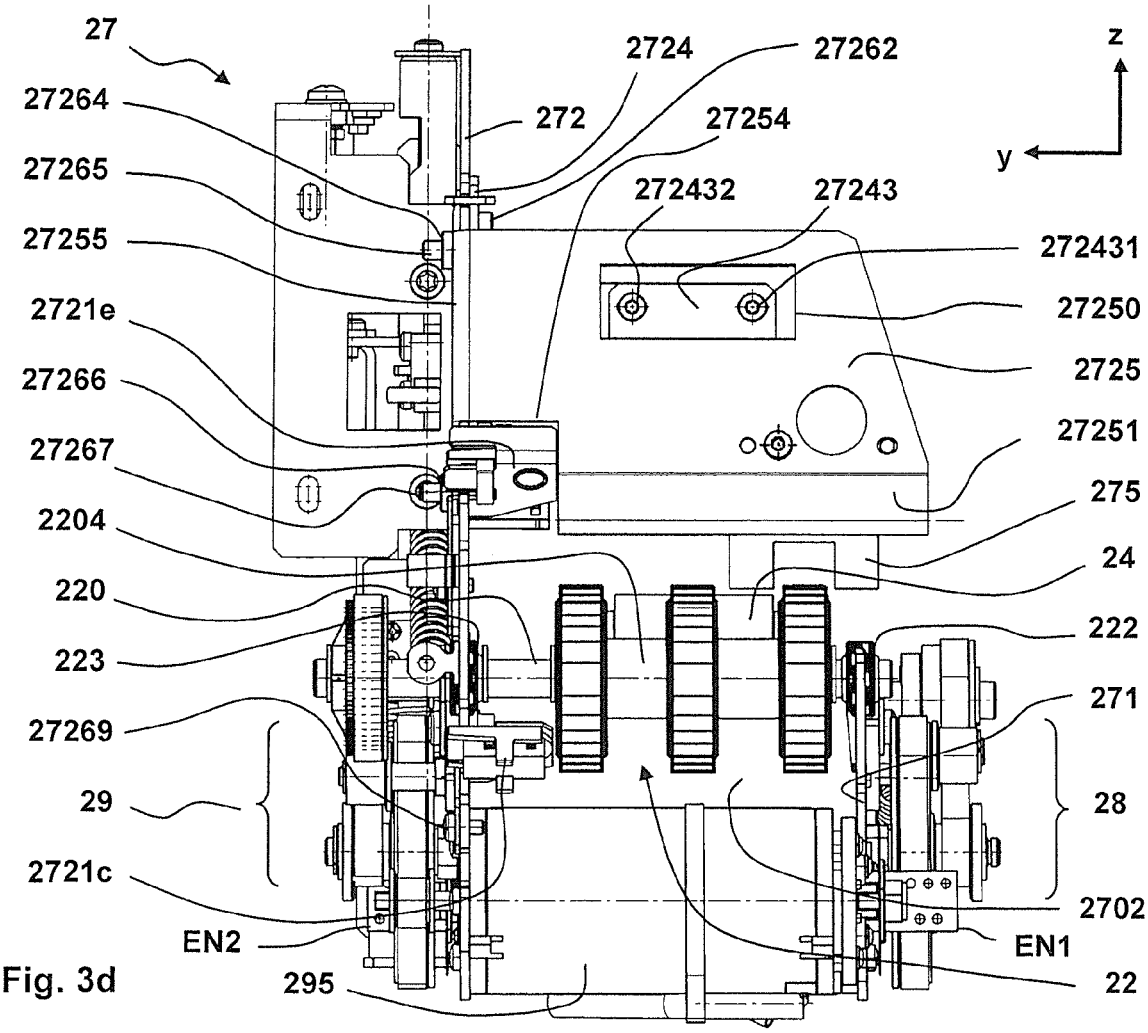
FIG. 3*d* is a side view of the mechanical design of the feed station, as seen from the left.

FIG. 3*d* shows the side view of the mechanical design of the feed station from the left. The rotation axle shaft 220 is installed in slide bearings 222 and 223 so as to be rotatable in the frame 27. A rotating roller body 2204 is arranged on the rotation axle shaft 220. The rotating roller body 2204 is internally provided with a free-running (freewheel) mechanism, wherein the free-running is active in the transport direction (x-direction). The rotation axle shaft 20 and the rotating roller body 2204 are components of the first separation roller 22. The second separation roller, which is arranged after the first separation roller 22 in the transport direction, is occluded by said first separation roller 22 in the presentation of FIG. 3*d*. The first transport roller 24 is arranged after the second separation roller in the transport direction. The second transport roller, which is arranged after the first transport roller 24 in the transport direction, is occluded by said first transport roller 24 in the presentation of FIG. 3*d*. The first transversal roller (occluded) is situated between the two transport rollers. The first actuation device 29 is arranged on the back side of the rear frame wall 272 and is driven by the direct current motor 295. The first actuation device 29 drives the two separation rollers. The second actuation device 28 is arranged on the front side of the front frame wall 271 and drives the two transport rollers. The second transversal wall 2702 is arranged between the first and second separation roller. Two pre-separation fingers 275 that are attached to the pre-separation plate 2725 are arranged above the first separation roller 22. The pre-separation plate 2725 has on its lower edge a stack stop surface 27251 at the intake side (in terms of mail flow). Both have a common opening 27254 in the immediate neighborhood of the bent plate part 27255 at the rear frame wall 272, wherein the common opening 27254 is provided for the application of the mount 2721*e* of the first light emitter. The bent plate part 27255 is attached on the rear frame wall 272 via the attachment means 27264 through 27267. The light emitter and the light collector are components of a photoelectric barrier that is used as a first sensor. The attachment of the mount 2721*c* of the first light collector likewise takes place via a locking screw 27269 on the back side of the rear frame wall 272. The pre-separation plate 2725 has at its upper edge (in the z-direction) a rectangular adjustment opening 27250 via which a roller support plate 27243 is accessible. The latter is attached indirectly (via bent plate parts) to the stop support plate 2724 via adjustment and attachment means 272431, 272432. The stop support plate 2724 is held via bolts 27262 on the front side of the rear frame wall 272 so that it can slide. An encoder EN1 is arranged on the side of the second actuation device 28 and detects the driving of the two separation rollers. An encoder EN2 is arranged on the side of the first actuation device 29 and detects the driving of the two transport rollers. The encoders are designed in a known manner. Arranged on each motor axle shaft is an encoder wheel which is scanned by an electronic encoder. For reasons of better clarity, in FIG. 3*d* the pressure carriage with the rocker and some elements of the frame or, respectively, of the actuation device that have already been explained using FIG. 3*b* have not been shown.

Figure 3G:
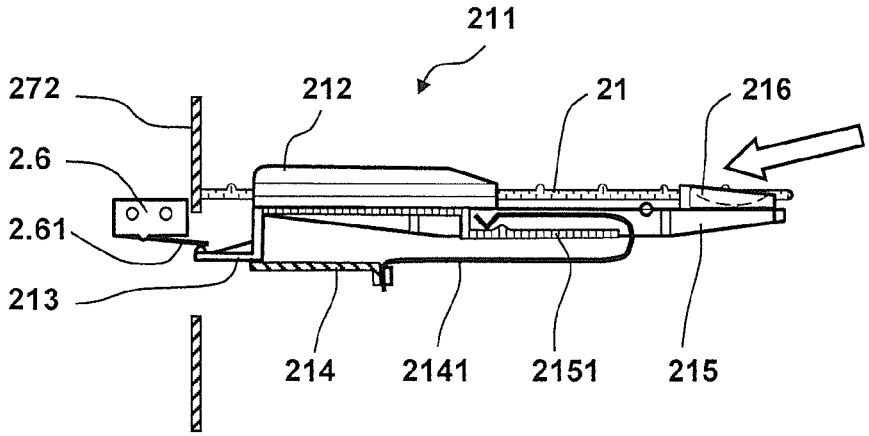
FIG. 3*g* shows actuation device of the feed station in side from, as seen from the left.
Figure 3E:
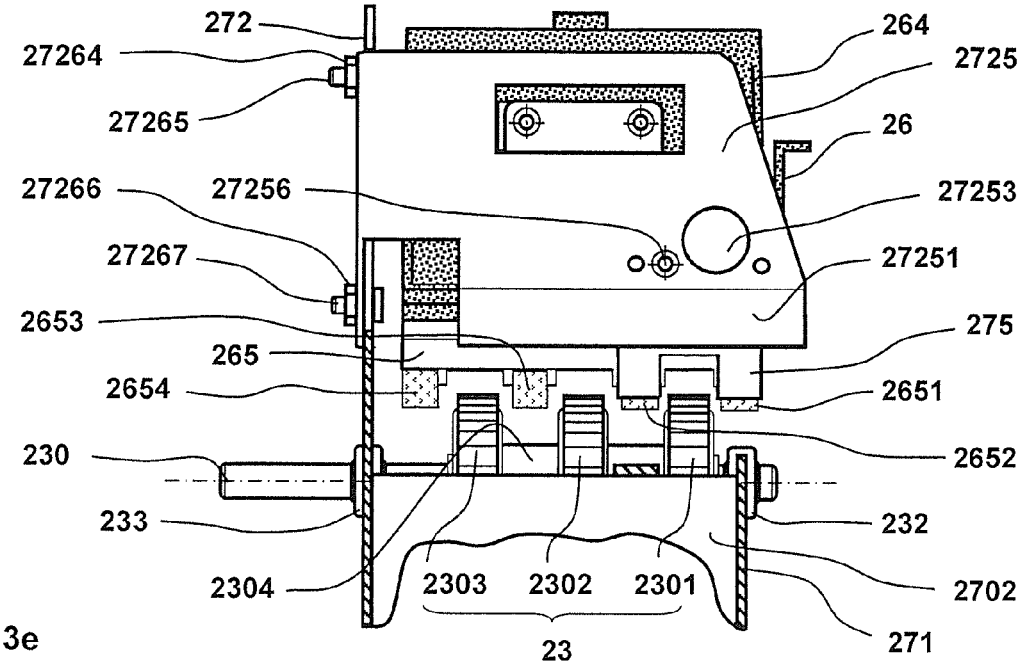
FIG. 3*e* is a cross-section through the frame.

FIG. 3*e* shows a section transversally through the frame before the second transversal wall 2702, wherein the second transversal wall is arranged between the front frame wall 271 and the rear frame wall 272. The second separation roller 23 has a roller rotation body 2304 with integrated free-running mechanism into which the rotation axle shaft 230 plugs. The rotation axle shaft 230 is installed in slide bearings 232 and 233 so as to be able to rotate in the front frame wall 271 and rear frame wall 272. Three rubber wheels 2301-2303 are installed on the roller rotation body 2304. Separation fingers 2652 and 2653 that are attached below a ramp plate 265 project into the interstices of the wheels. The remaining separation fingers 2651 and 2654 protrude onto the outer edge of the roller rotation body 2304 next to the rubber wheels 2301 and 2303 below the ramp plate 265 at which the separation fingers are attached. In the shown example, their attachment takes place via a clamping (not shown) of a rubber plate that has four comb-shaped separation fingers. However, the attachment can also take place in another manner. The ramp plate 265 is arranged at the head of the rocker 264. For better clarity, in FIG. 3*e* some elements of the frame and of the actuation device are omitted compared to FIG. 3*d*. For this purpose, the pressure carriage 26 with the rocker 264 is shown and emphasized via a dot pattern. The pressure carriage 26 with the rocker 264 is predominantly produced from plastic, while the frame is essentially formed of sheet metal. The rocker 264 is mounted so as to be able to rotate in the pressure box 26. Arranged before the head of the rocker in the frame is the pre-separation plate 2725 to which the pre-separation fingers 275 are attached. The stack stop surface 27251 lies on the lower edge of the pre-separation plate 2725. A locking screw 27256 serves for the attachment of the pre-separation fingers 275 and is arranged above the first rubber wheel 2301 via the stack stop surface 27251 on the pre-separation plate. A circular adjustment opening 27253 is provided between the lateral edge of the pre-separation plate 2725 (which lateral edge is slanted upwardly) and the locking screw 27256. The slanted lateral edge is opposite the bent plate part which is attached to the rear frame wall 272 by means of the attachment means 27264 through 27267.

Figure 3F:
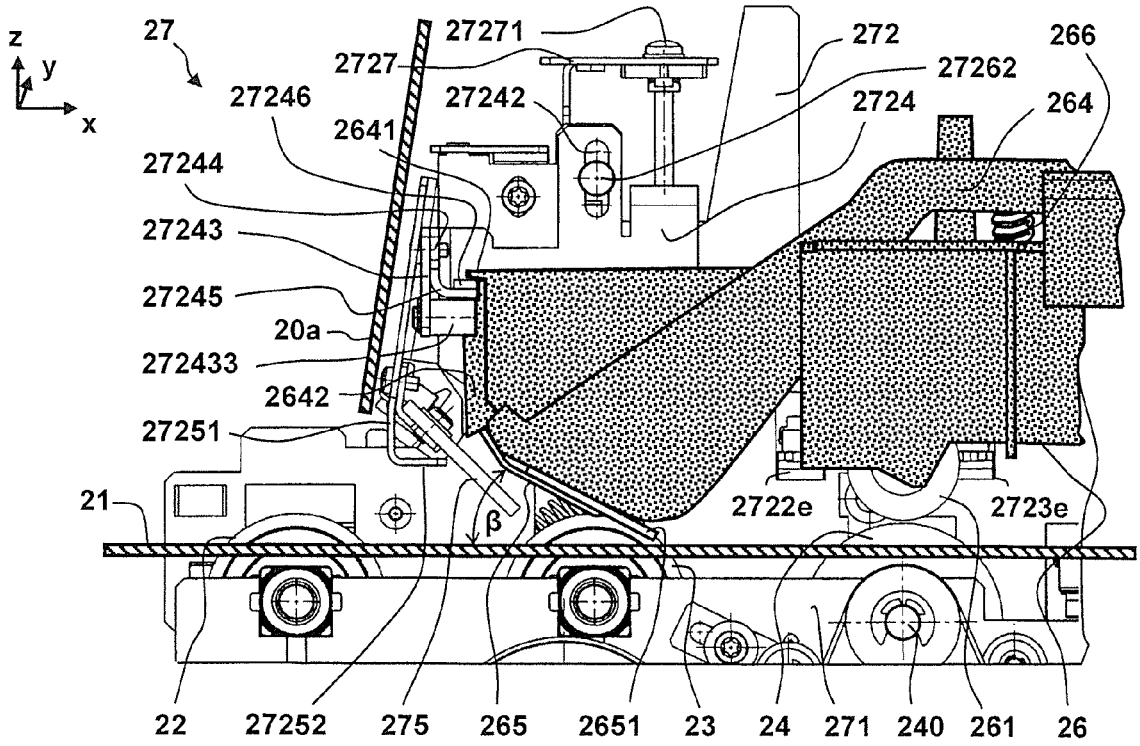
FIG. 3*f* is a view of the separation region in the frame, as seen from the front.

FIG. 3*f* shows a view of the separation region in the frame from the front. The stop support plate 2724 is situated with its surface parallel to the x/z-plane. An angle plate 27244 is bent at a right angle from the x-plane; its surface is situated parallel to the y/z-plane. A rubber stop cushion 27246 is advantageously attached via glue to the angled stop piece 27245 bent away from this in the transport direction.

It is provided that the separation device has a sluice for flat items that is formed in multiple stages in the separation region and comprises at least one pre-sluice. A stack of mail pieces is placed on the feed deck 21 and rests on the wall of the housing part 20*a* of the feed station at the mail intake. The housing is made of a plastic. A clearance of approximately 5 mm exists from this housing wall up to the stack stop surface 27251 of the frame 27. All mail pieces of a stack with a stack height greater than 23.5 mm can thereby not simultaneously strike the stack stop surface when the first separation roller 22 is driven, which first separation roller 22 protrudes approximately 6.5 mm above the surface of the feed deck 21. The lower edge of the housing part 20*a* forms a first stage that lies approximately 30 mm in parallel above the surface of the feed deck 21. The first stage and the second separation roller 22 form the first pre-sluice. A second stage for retention of the mail pieces of the stack forms a stationary, step-shaped curved angle plate 27251, 27252 at the lower edge of the pre-separation plate whose components are situated at an angle and/or orthogonal to the transport direction. In the explained exemplary embodiment, the underside of the step of the plate 27252 lies approximately 18.5 mm above the surface of the feed deck 21. As a result of this, only a single thick mail piece with a maximum thickness of 12 mm can pass this step, or multiple thin mail pieces. Following after the aforementioned step are the pre-separation fingers 275 attached above and pointing down at an angle in the transport direction, and the ramp plate 265 likewise arranged at an angle. The latter, together with the second separation roller 23, forms the primary sluice. The ramp plate 265 does not extend up to the intervening space between the rubber wheels of the second separation roller 23, in contrast to the separation fingers 2651, 2652, 2653, 2654. Via the rotation of the separation rollers, those mail pieces which lie at the lower end of the stack are fanned out at the ramp plate 265 since the acute angle β of the ramp plate 265 relative to the surface of the feed deck 21 does not allow mail pieces stacked at an incline. The aforementioned angle β is in a range from 30° to 45°. The height of the stop of the rocker head at the rubber stop cushion 27246 relative to the surface of the feed deck 21 (and therefore also the angle β) can be varied by means of the adjustment screw 27271. The means 2724, 27242, 27262, 2727 and 27271 are provided for adjustment of the stop of the rocker head. A roller support plate 27243 is also attached to the angle stop piece 27245 so as to be adjustable. The roller support plate 27243 supports two rollers of the same design, of which only the first roller 272433 (which occludes the second roller 272434) was shown. At the upper end of the projection shaped at the head of the roller 264, a stop element 2641 is shaped which is brought to a stop with the rubber stop cushion 27246. The tensile force required for a stop is applied by a tension spring 266 installed on one side in the pressure box 26 and at the other side on the rocker 264. The pressure box 26 has the first pressure roller 261 which is elastically installed (the manner is not shown) and situated opposite the first transport roller 24. The pressure box 26 has the second pressure roller 262, shown downstream in terms of the mail flow in FIG. 3*b*. It is likewise elastically installed (the manner is not shown) and situated opposite the second transport roller 25. The transport rollers and separation rollers 22 and 23 are arranged between the front frame wall 271 and the rear frame wall 272 in the frame 27. The separation finger 2651 covers the remaining separation fingers. All separation fingers are squeezed between the ramp plate 265 and the head of the rocker 264. The ramp plate 265 can be adjusted via the circular opening in the pre-separation region.

An operation device of the feed station which has a button 216 that is arranged on the feed deck 21 at the front side of the apparatus is shown in a side view from the left in FIG. 3*g*. The button is also called a seal button 216 (see FIG. 2) and on the one hand serves for operation of a letter sealing device (known per se; not shown) and on the other hand for the input of information via a microswitch 2.6 in a control unit (shown in FIG. 4*a*) of the feed station. In the shown position, the information that the letter sealing device has been deactivated is input into the control unit. A flap deflector of the cited convexly shaped formed part 212, which clip deflector is upstream in terms of the mail flow, projects at an elevation in the z-direction over the feed deck 21 and thereby prevents that a flap of an envelope may arrive below a blade of the letter closing device. The shaped part 212 and the button 216 are permanently mechanically connected with one another via a lever 215. The shaped part 212 is arranged on the front side of the rear wall 272 of the frame, and the microswitch 2.6 is arranged on the back side. The shaped part 212 is molded at the one end of the lever. The rear wall 272 has an opening through which a leaf spring 2.61 of the microswitch 2.6 protrudes forward. The microswitch 2.6 is operated via the leaf spring 2.61, via the outer edge of a hook 213, wherein the hook 213 is shaped at the other end of the lever and subsequently points downwardly toward the shaped part 212. In the indicated position, the hook 213 rests with its inner edge on a top side of a housing part 214, wherein the surface of the top side of the housing part 214 is situated parallel to the x/y-plane of the Cartesian coordinate system. A leaf spring 2141 is attached to the housing part 214 with one of its ends that is curved in a U-shape, and its other end acts on the lever from above with a tensile force so that the hook 213 is pressed with its inner edge onto the surface of the top side of the housing part 214. The lever 215 has a floor plate 2151 which has on the inner side a contour which is adapted to the other end of the leaf spring 2141 and is shaped accordingly so that the leaf spring 2141 does not slide out if a force that displaces in the y-direction (in the arrow direction of the white arrow) acts from above on the button 216. The lever 215 then executes a movement (not shown), wherein the hook 213 slides down with its inner edge from the surface of the top side of the housing part 214. As a result, the microswitch 2.6 is then no longer operated, and the control unit of the feed station is thus signaled that the letter closing device has been activated.

Figure 4A:
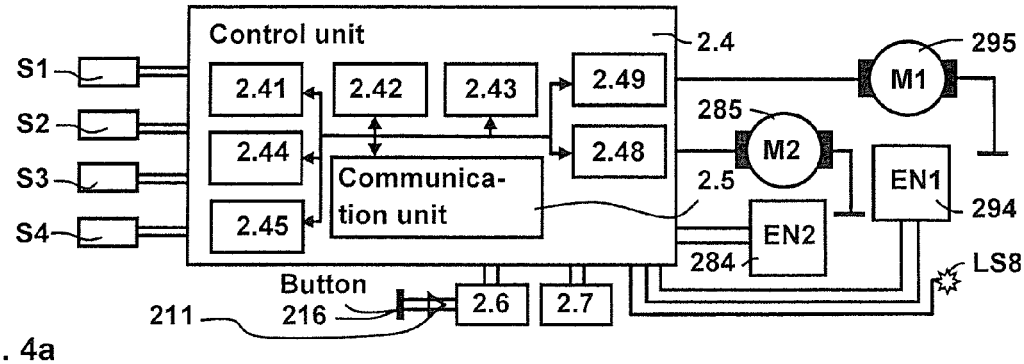
FIG. 4*a* is a block diagram of the basic components of the overall system.

In FIG. 4*a*, a block diagram is shown with a control unit 2.4 that is connected electrically with the sensors S1, S2, S3, S4 and encoders EN1, EN2 and in terms of control with the motors M1 and M2. The control unit 2.4 has a processor 2.41 for automatic determination of input values, a program memory 2.42, and a memory 2.43 for the automatically determined input variables and for additional input variables to be entered manually. The control unit includes a signal processing unit 2.44 for the signals of the sensors and the encoders EN1, EN2, as well as determination unit 2.45 to determine the position of the flat item in the transport path. The aforementioned components—such as the processor 2.41, the signal processing unit 2.44 and encoder EN1 or EN2—operate for the purpose of regulating the rotation speed for the motor M1 of the separation device or for the purpose of regulating the rotation speed for the motor M2 of the transport device, for example. As is generally known, the purpose of regulating the rotation speed exists in automatically keeping the rotation speed constant, independent of fluctuations in the load or the power feed. A defined desired value of the separation and transport velocity can thus be maintained.

For example, the processor 2.41, the signal processing unit 2.44, the third sensor S3 and the encoder EN2 cooperate in order to determine the length of a mail piece. The third sensor S3 is advantageously designed as a photoelectric barrier. During the transport of a mail piece, a counter of the determination unit 2.45 counts the pulses delivered from the encoder EN2. The count state $Z_1$ of the counter is determined as soon as an interruption of the light beam has been detected by means of the third sensor S3, which the processor interprets as a leading edge of a mail piece. A count state $S_3$ is determined if a light change that the processor interprets as the trailing edge of the same mail piece is detected by means of the sensor S3. The length of the mail piece results as a count spacing from the difference of the count states $L=Z_3-Z_1$.

Alternatively, in principle the determination of the length of a mail piece can also take place in the same manner with the participation of the second sensor S2.

Due to the continued counting of the counter, the position of the mail piece or, respectively, flat item in the transport path results using the count value. The motors M1 and M2 are advantageously direct current motors 295, 285 that are controlled via the driver units 2.48, 2.49 of the control unit 2.4. The driver unit 2.49 is designed for an instantaneous stop of the motor M1. The encoders EN1, EN2 are advantageously designed and arranged as has already been explained using the encoders 385, 295 of FIGS. 3*a* through 3*d*. The signal processing means and the processor are used for measurement, control and regulation purposes for both motors. A gap (interval) measurement is based on a first count value of the pulses of the encoder EN2 that is reached if the trailing edge of the mail piece is detected by means of the processor and sensor S2, and on a second count value of the pulses of the encoder EN2 that is reached when the leading edge of the subsequent mail piece is detected by means of the processor and sensor S2. The count spacing between the two count values corresponds to the current gap Dreal between the mail pieces.

In principle, the determination of the gaps between successive mail pieces can also similarly take place in the same manner with the participation of the third sensor S3.

The aforementioned means—signal processing unit 2.44 and/or determination means 2.45—can be a hardware and/or software component of the processor.

The aforementioned means—signal processing unit 2.44 and/or determination means 2.45 and driver units 2.49, 2.48—can alternatively be a component of an input/output unit that is realized with discrete design elements.

Alternatively, it is provided that a freely programmable gate array (FPGA) or an application-specific integrated circuit (ASIC) is used. An FPGA is advantageously used which is programmed as an input/output unit. A suitable programmable logic is the Spartan-II 3A FPGA from the company XILINX (www.xilinx.com), for example.

The feed station can also include additional assemblies, for example a closing module or a closing device. An operation device 211 with the button 216 installed at one end thereof can bring the closing device into an operating position, wherein the microswitch 2.6 arranged at its other end is operated, which signals the operating position to the control unit 2.4. A sensor S4 is associated with the closing device and connected with the control unit 2.4 in order to signal the position of the flap. An error detection in the feed station is thus also possible. The control unit 2.4 is connected with a light source LS8 that is activated in the sealing operation. The control unit 2.4 has a communication unit 2.5 which has a communication connection with a franking machine via an interface 2.7 (the manner is not shown). Alternatively, however, the communication unit 2.5 can also be arranged external to the control unit 2.4 and be connected with the latter in terms of communication.

Figure 4B:
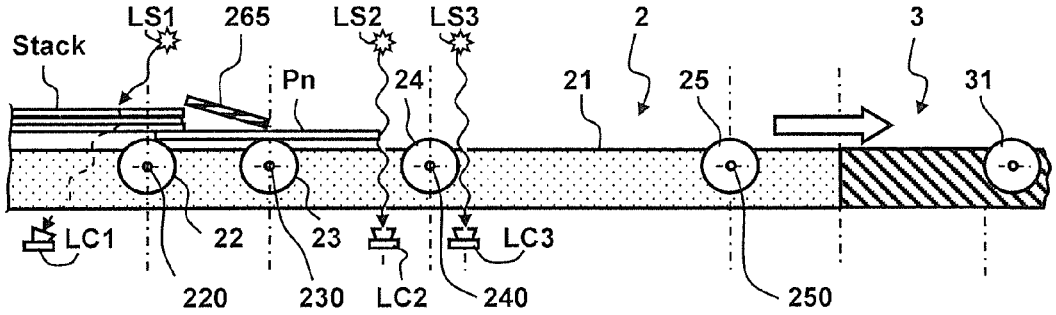
FIG. 4*b* illustrates the principle of the feed of items in accordance with the invention.

A presentation of the principle of the feed arises from FIG. 4*b*. The feed station 2 respectively has two separation rollers 22, 23 arranged on the axle shafts 220, 230 and two transport rollers 24, 25. The latter are respectively arranged on the axle shafts 240, 250. The axle shafts 220, 230 and 240, 250 are driven at different times and with different revolution speed by the motors M1 and M2 (the manner is not shown) so that a mail piece Pn situated at the bottom in the stack is reliably separated. The sensors are designed as photoelectric barriers. The first sensor comprises a light source LS1 arranged above the feed deck 21 and a light collector LC1 arranged below the feed deck 21 that is coupled to the light source via a light beam and detects any interruption of said light beam. The sensors are identical in design but arranged at different positions in the transport path. A gap is formed between the ramp plate 265 and the second separation roller 23 and limits the thickness of the mail piece to be separated. After separation, the mail piece Pn is transported further in the transport direction (white arrow) on the surface of the feed deck 21 along the transport path to the input roller 31 of the franking machine 3. Another flat item can similarly be separated from a stack and transported. The light source LS1 lies downstream (in terms of the mail flow) from the axle shaft 220, but the light collector LC1 lies upstream (in terms of the mail flow) from said axle shaft 220. The light sources LS2 and LS3 are situated downstream (in terms of the mail flow) of the axle shaft 220 and orthogonally opposite the associated light collectors LC2 and LC3. The second photoelectric barrier LS2, LC2 is arranged upstream (in terms of the mail flow) of the axle shaft 240 of the first transport roller 24. The third photoelectric barrier LS2, LC2 is arranged downstream (in terms of the mail flow) of the axle shaft 240 of the first transport roller 24. Both photoelectric barriers are arranged orthogonal to the transport path at the frame.

Figure 4C:
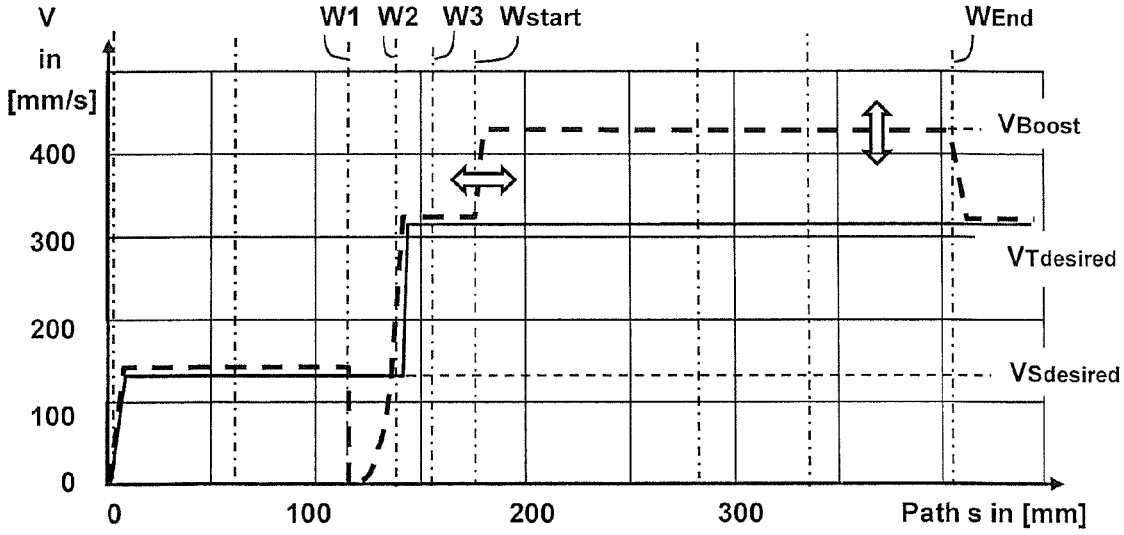
FIG. 4*c* is a velocity/path diagram for a flat item.

FIG. 4*c* shows a velocity/path diagram for a flat item. A path s traveled by the leading edge of the mail piece along the transport path is plotted in mm on the abscissa axis. The value of the velocity V of the leading edge of the mail piece is indicated on the ordinate axis. The position of the axle shaft 220 results via an orthogonal mapping to a path point of the transport path and has been indicated as the left-most dash-dot line, next to the ordinate axis. The positions—such as path point of the axle shaft 230, axle point W1 of the second sensor S2, path point W2 of the axle shaft 240 and path point W3 of the third sensor S3 (which have likewise each been indicated using a dash-dot line) follow one after another in the transport path. The aforementioned positions are aligned with the positions indicated in FIG. 4*b*. A function curve of the velocity V of the leading edge of the mail piece Pn—which function curve rises in steps from the desired value of the separation velocity VDesired—is indicated by a solid line. In contrast to this, the function curve of the velocity V of the leading edge of the mail piece Pn+1 (drawn with a dashed line) shows a rising and falling curve (upon stopping at the path point W1) during the separation. Given a gap that is too small, the distance from the leading mail piece Pn is increased by the stopping. A gap that is too large is reduced to a predetermined distance Dmin from the mail piece Pn by causing the velocity V of the leading edge of the mail piece Pn+1 to increase further at the path point Wstart. At the path point WEnd, the velocity V is reduced again to a predetermined desired transport velocity (for example VTdesired =320 mm/s) before the leading edge of the mail piece Pn+1 reaches the intake roller 31 of the franking machine 3.

From FIG. 4*a* it can be seen that the control unit 2.4 is connected at the output side with a transport motor M2 for driving the transport device with the transport rollers 24, 25. The processor 2.41 is programmed via an application program stored in a program memory 2.42 of the control unit 2.4 so as to:

i) control the separation motor M1 of the separation device so that a current gap that is too small is increased to a minimum gap Dmin, and ii) control the transport motor M2 so that a separated flat item is transported downstream (in terms of mail flow) and supplied to a subsequent mail processing apparatus with a predetermined transport velocity, wherein the transport velocity is varied automatically before the feed depending on the stored data of a preceding separated flat item and the position of the current flat item to be separated, such that a gap that is too large between the goods is reduced to a predetermined distance and a predetermined throughput of flat items results.

The predetermined distance is a path distance or time distance between the flat items that follow in immediate succession.

Furthermore, the processor 2.41 is designed to automatically determine input variables and is connected with a storage means 2.43 for the automatically determined input variables and additional input variables entered manually, so that the control unit controls the separation motor M1 and the transport motor M2; with the control being based on a number of suitable desired velocity values or machine-specific path and/or time values for the separation and transport of a flat item which are applied depending on the determined dimension and position of the flat item in the transport path.

The individual phases of the transport of a flat item are shown in FIGS. 5*a*-5*j*, which are explained in connection with FIG. 6.

Figure 6:
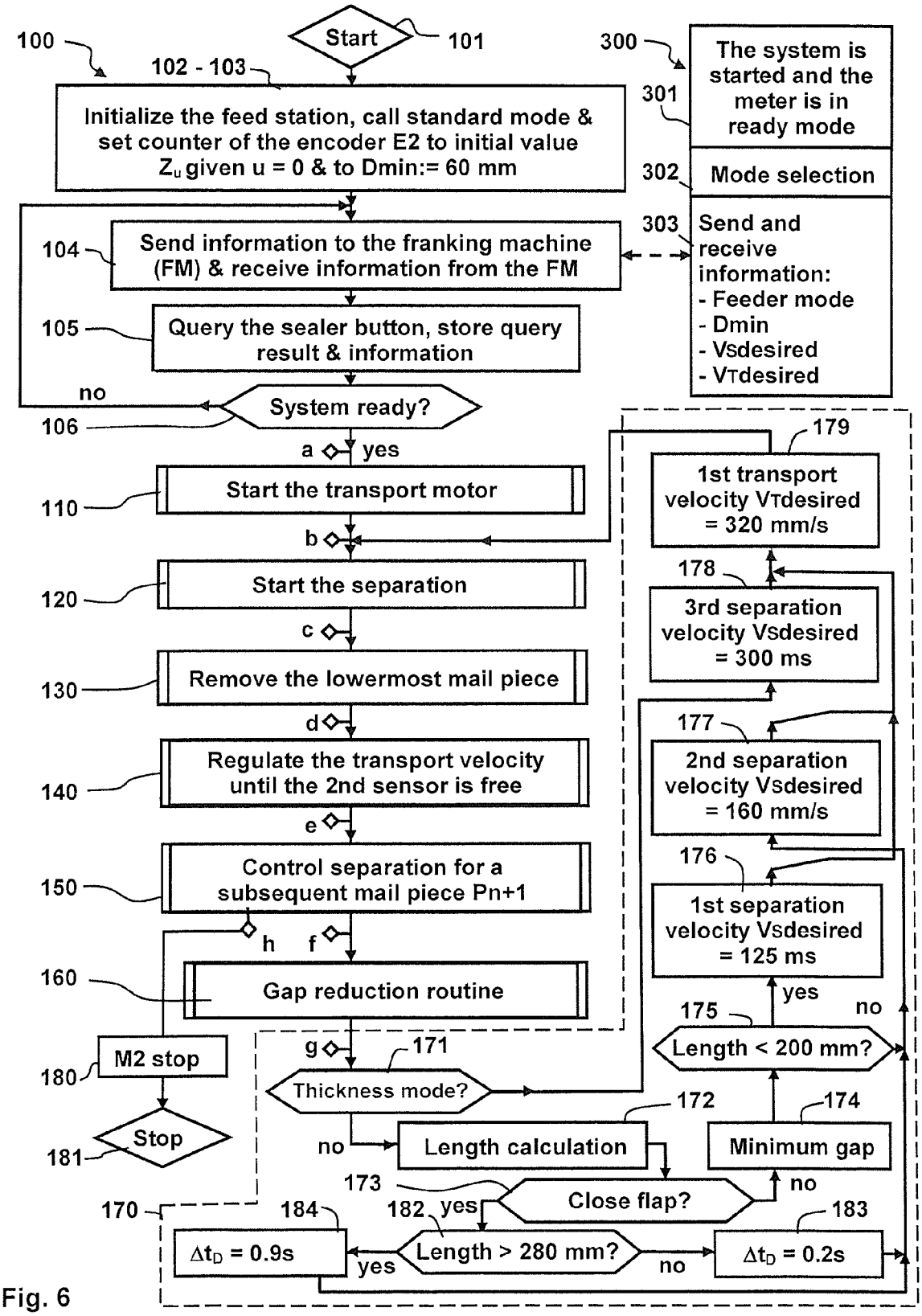
FIG. 6 is a flowchart of the transport of flat items according to the invention.

A program workflow for a processor of the control unit is shown in FIG. 6, and sub-programs for the program workflow are shown in FIGS. 7 through 12. The program workflow 100 according to FIG. 6 provides Steps 102-103 for initialization of the feed station after a start Step 101. The processor of the control unit is programmed to load an associated user program and initial parameters after an initialization in order to subsequently invoke a standard mode in which the feed station can operate.

The initial parameters are desired values for at least:

the first predetermined separation velocity in the standard mode, for a first predetermined transport velocity in the standard mode, for the minimum clearance of the mail pieces from one another in the standard mode.

The control unit of the feed station is adjustable to different velocities for thick (thickness mode) and non-thick mail pieces (standard mode). It is provided that the separation velocity for thick mail pieces is higher in thickness mode than for non-thick mail pieces in standard mode. The dimensions of the mail piece are thereby assumed.

For example, Deutsche Post AG requires mail pieces with the following maximum dimensions (mail format DIN-B):

| Abbreviation | Designation | Height | Width | Length |
|---|---|---|---|---|
| M-DIN B4 | Maxibrief | 50 mm | 250 mm | 353 mm |
| G-DIN B4 | Groβbrief | 20 mm | 250 mm | 353 mm |
| K-DIN B6 | Kompaktbrief | 10 mm | 125 mm | 235 mm |
| S-DIN B6 | Standardbrief | 5 mm | 125 mm | 235 mm |

Assuming that postcards have a shorter length (L=162 mm) than a standard letter, an automatic length measurement is implemented in order to determine the difference between standard letter and postcards.

However, instead of automatically conducting a direct thickness measurement via an additional sensor in order to determine the height, in contrast to this a thickness mode for a "compact letter" is entered manually. A setting of a defined operating mode for the feed station takes place via the display of a franking machine which is apparent from FIG. 1.

Furthermore, it is provided that, in standard mode, the separation velocity for "normal" mail pieces of medium thickness ("standard letter") is greater than for postcards or other thin mail pieces, wherein it is assumed that the postcards have a length shorter than 200 mm. Additional control parameters can be selected for different mail pieces (letters) in the sealing operation or in non-sealing operation.

Figure 5A:
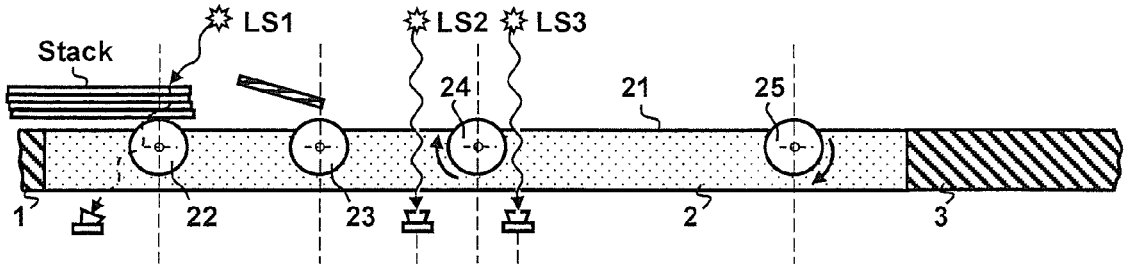
FIGS. 5*a*-5*j* show individual phases of the transport of a flat item.
Figure 5B:
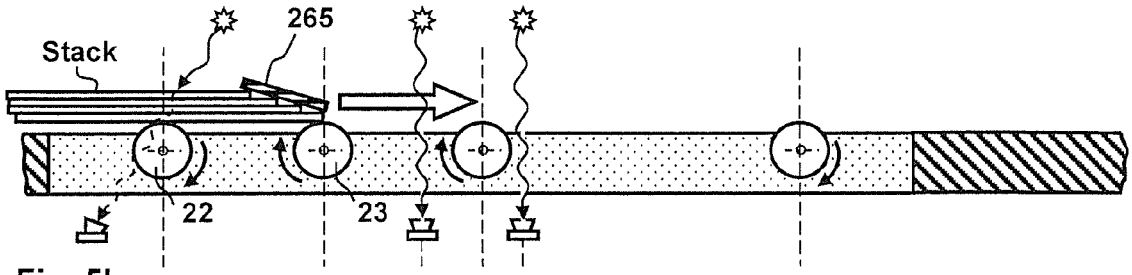
Figure 5C:
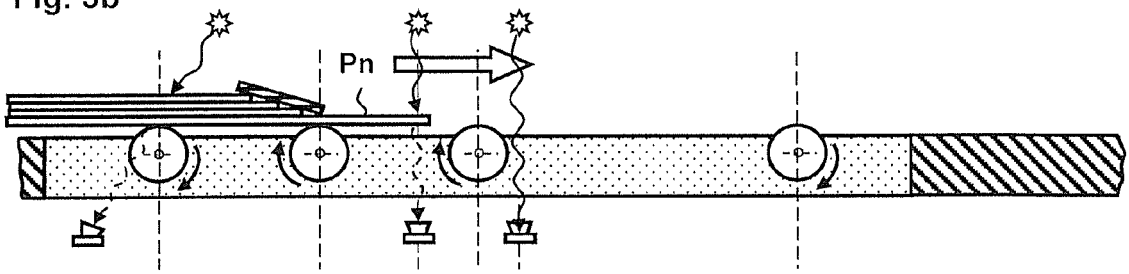
Figure 5D:
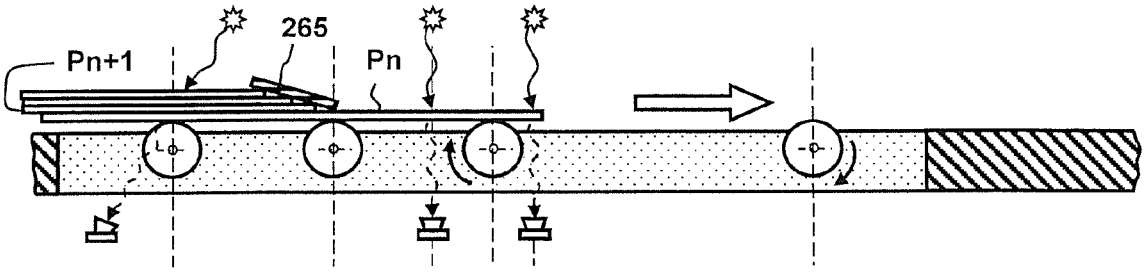
Figure 5E:
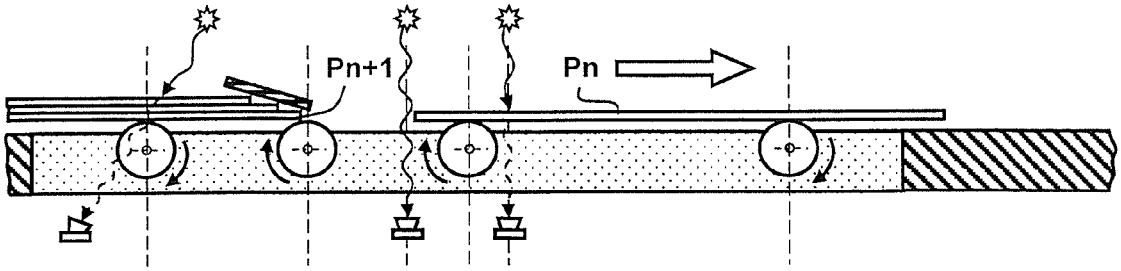
Figure 5F:
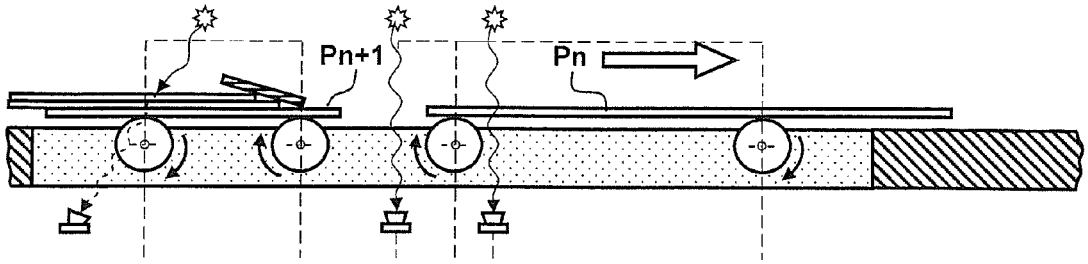

In the pre-separation region, a stack of mail pieces is placed on the feed deck and the first separation roller 22 of the feed station 2 (see FIG. 5*a*).

Figure 7:
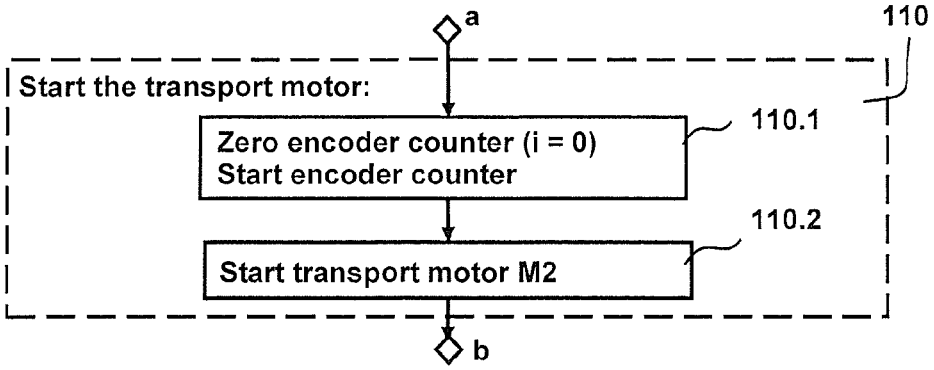
FIGS. 7 through 12 show sub-programs of the flowchart of FIG. 6.
Figure 8:
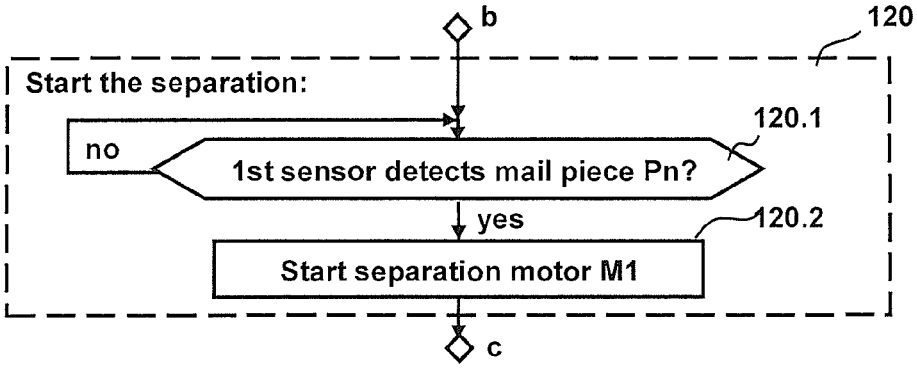
Figure 9:
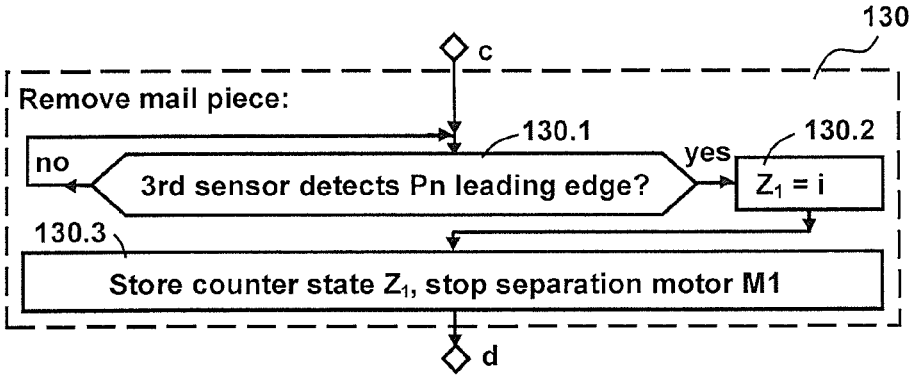
Figure 10:
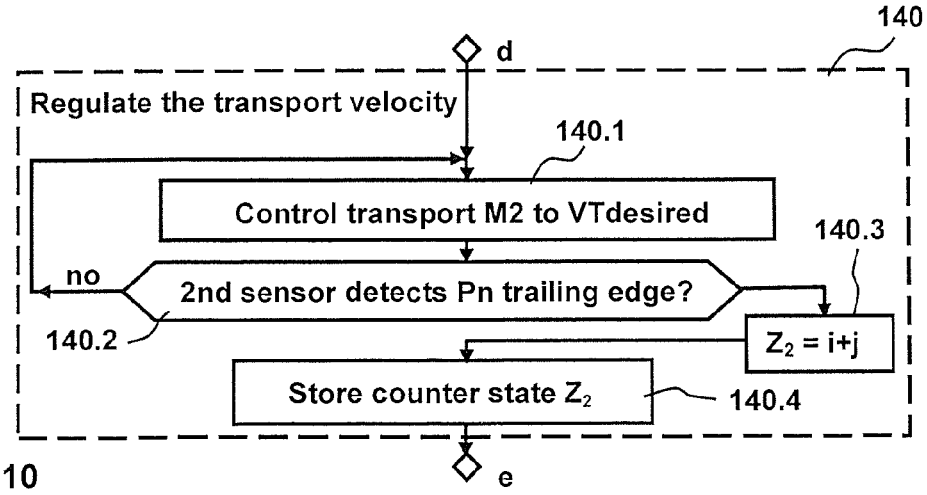

In Step 104, the program workflow plan according to FIG. 6 provides to send information to the franking machine and receive information from said franking machine. This naturally requires that the entire system be turned on, which is apparent from FIG. 1. In the operationally ready mode, the meter or the franking machine waits after the system has been started, which likewise arises from Step 301 of the workflow 300 (likewise shown in FIG. 6). The operator of the system can now make inputs at the franking machine. In Step 302, the mode selection is detected by the franking machine and sent in Step 303 to the feed station as soon as a corresponding requirement for this is present at said feed station. The information for mode selection that is sent from the franking machine is received and recognized by the feed station and stored in Step 105. Moreover, a query is implemented as to whether the button of the feed station has been operated, which enables an additional sealing function. The query result is likewise stored in a memory of the control unit. The workflow now branches back to Step 104 if the system is not yet ready. Otherwise, the workflow branches to the sub-program 110 in which the encoder counter is set to a value of zero and started in Step 110.1. and the transport motor is started in Step 110.2 (FIG. 5*a*, FIG. 7). The workflow subsequently branches to the sub-program 120 in which the separation of the mail piece to be separated is started (see FIG. 5*b* and FIG. 8). In Step 120.1, the workflow waits and a query is made as to whether the first sensor S1 detects a mail piece at the separation region. The separation motor is accordingly started in Step 120.2. In Step 130.1 of the subsequent sub-program 130, the workflow waits and a query is made as to whether the third sensor detects the leading edge of the mail piece Pn. If yes, a first count state Z1 is determined. In the subsequent Step 120.3, the count state is stored and the separation motor is stopped (see FIG. 5*d* and FIG. 9). The mail piece is lying at the very bottom of the mail stack can now be removed from said mail stack by rotating the first transport roller, wherein a free-running of the separation rollers is active. The workflow subsequently branches to the sub-program 140.

In the sub-program 140, a regulation of the transport velocity to the first predetermined desired value for the mail piece Pn (see FIGS. 5*d*, 5*e* and 10) takes place. In Step 140.1, the transport motor M2 is controlled at the first predetermined desired value VTdesired until the second sensor has detected the trailing edge of the mail piece Pn in Step 140.2. A second count state $Z_2$ of the counter for the encoder pulses of the encoder EN2 is then determined in Step 140.3 and stored in Step 140.4.

Figure 5G:
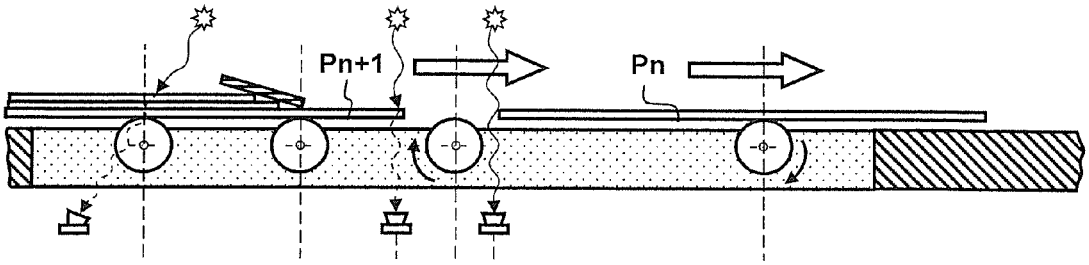

As soon as the trailing edge of the mail piece Pn leaves the region detected by the second sensor (see FIG. 5*e*), after this in the following sub-program 150 a separation of the subsequent mail piece Pn+1 can be controlled (see FIG. 5*f* and FIG. 11) as long as an additional mail piece Pn+1 is still present at the feed station, which is detected in Step 150.1. In Step 150.3, a query is made as to whether the third sensor S3 detects the trailing edge of the mail piece Pn. In the event that this is the case (as shown in FIG. 5*g*), in Step 150.4 the count state of the counter is determined and in Step 150.5 the count state of the counter is stored as new data of the preceding mail piece. In Step 150.6 of the same sub-program, it is detected that the second sensor detects the leading edge of the subsequent mail piece Pn+1 (see FIG. 5*g* and FIG. 11). In Step 150.7, a fourth count state $Z_4$ of the counter is determined that is required in order to determine the size of the current gaps. In Step 150.8, a gap Dreal<Dmin has been determined; the count spacing Z(Dreal) is smaller than the minimum count spacing Z(Dmin), which is detected in Step 150.9. A delay set corresponding to that delay predetermined in the initialization in Steps 102-103, or corresponding to a preset routine, is determined for the separation motor M1 in Step 150.10. The separation motor M1 is stopped in Step 150.11 and then started again after the determined delay. The delay is calculated so that the minimum gap is at least achieved. The processor can calculate the delay duration based on the present encoder count states and the known transport velocity. Given an activated sealing function, the delay is adjusted to a predetermined minimum time gap $\Delta t_D$. However, in the event that it was established in Step 150.1 that no additional mail piece Pn+1 is present at the feed station, a point h is then achieved, the workflow branches to Step 180 and the transport motor M2 is deactivated. A stop Step 181 is subsequently reached that ends the routine 100.

Figure 5H:
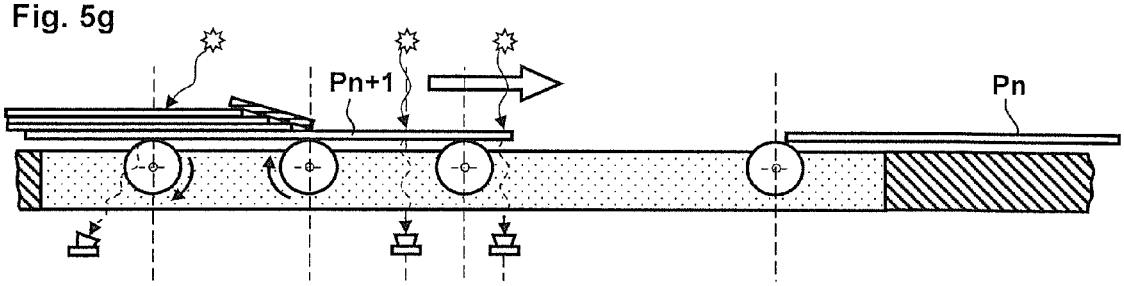

However, if an additional mail piece Pn+1 is present at the feed station, the separation motor M1 is started again, and a point f is reached after a pass through Steps 150.12-150.14 to establish that the leading edge of the mail piece Pn+1 has arrived in the region of the third sensor S3 (FIG. 5*h*). After this, a gap reduction routine (see FIG. 12) is started in the sub-program 160. However, given a first removed mail piece Pn this routine can be skipped in that no bit is set, which is queried in the first Step 160.1 (see FIG. 12). A digital control of the transport motor at the first transport velocity VTdesired is provided as a last Step 160.8 of the gap reduction routine 160. After this, a point g is reached, and therefore a beginning of an additional sub-program 170 which is used for automatic presetting of the control unit in order to achieve the desired throughput of mail pieces with maximum certainty of separation. In a first query Step 171, the processor thereby queries whether the thickness mode has been stored (in Step 105) in the stored mode setting. The workflow branches to a subsequent Step 172 if this was not the case. In the aforementioned Step 172, a length calculation is implemented to calculate the length of the mail piece based on the stored encoder data. In the subsequent query Step 173, the query result is checked as to whether that (sealer) button has been operated which produces a sealing function to seal the flap of the envelope of the mail piece. If it is not the case that the flap is to be closed (thus in a non-seal operation), the workflow branches to Step 174 in order set a desired value for a minimum gap. Otherwise—thus in the seal operation, i.e. in the case in which the flap is to be sealed—the workflow branches to the query Step 182. If it is established in the query Step 182 that the length of the mail piece exceeds a second length value (for example the limit value L2=280 mm), in Step 184 a time gap is set which corresponds to a first duration of $\Delta t_D$=0.9 (seconds). If it is not the case that the length is greater than L2=280 mm, the workflow branches to Step 183 in order to set a time gap which corresponds to a second duration of $\Delta t_D$=0.2 (seconds).

In Step 174, a desired value is set for the minimum (path) gap depending on the intended throughput. Given a throughput of 60 mail pieces per minute, the minimum gap should amount to Δs=60 mm, for example. Given a throughput of 65 mail pieces per minute, the minimum gap between two immediately successive mail pieces should amount to Δs=35 mm, for example.

From Step 174, the workflow branches to the query Step 175. In the query Step 175, it is established whether the length of the mail piece falls below a first length value (for example the limit value L1=200 mm). If that is the case, a Step 176 is then reached in which the separation velocity is set to a first desired value $VS_{desired}$=125 mm/s. However, if it is not the case, the workflow branches to Step 177, in which the separation velocity is set to a second desired value $VS_{desired}$=160 mm/s. The workflow also branches to Step 177 after passing through Steps 183 or 184.

Figure 5I:
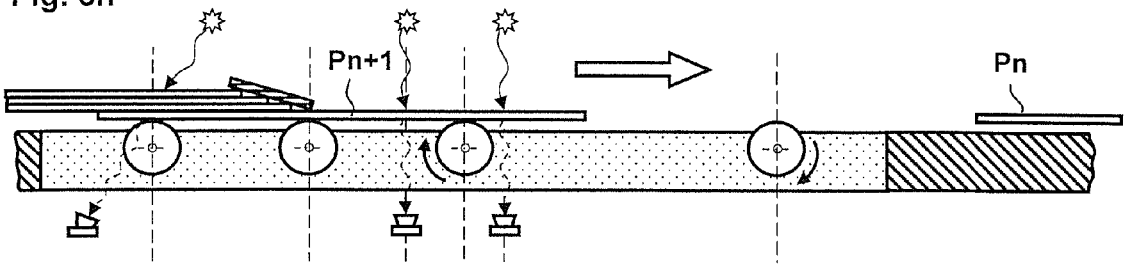
Figure 5J:
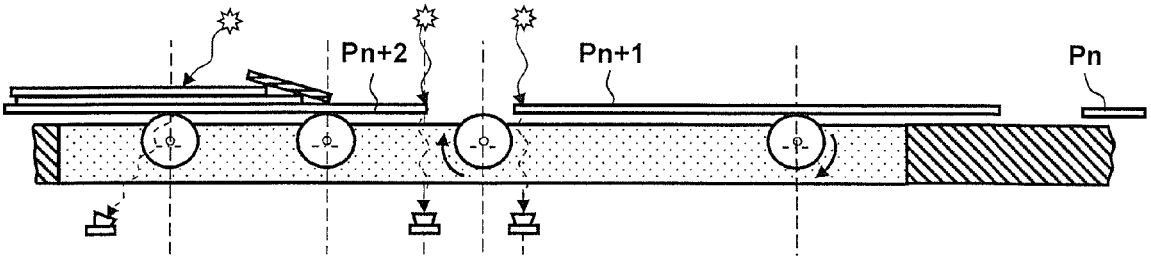

In query Step 175 a check is made as to whether the length is less than L1=200 mm. In such a case, short (and normally thin) mail pieces are present in the placed stack. Since their separation is difficult, in the following Step 176 the separation velocity is preset to a first desired value $VS_{desired}$=125 mm/s. Otherwise, standard letters of medium thickness are in the stack, which can be reliably separated. In Step 177, the separation velocity can consequently be preset to a second desired value $VS_{desired}$=160 mm/s, wherein the second desired value is greater than the first desired value. In Step 179, the transport velocity is subsequently preset to a first desired value $VT_{desired}$=320 mm/s. However, if the thickness mode has been selected before the separation, the workflow branches to a subsequent Step 178 and the separation velocity is preset to a desired value of $VS_{desired}$=300 mm/s. Step 179 is subsequently reached again, and the transport velocity is preset to the desired value $VS_{desired}$=320 mm/s. From Step 179, the workflow branches to point b and the routine with Steps 120 through 170 is repeated for a following mail piece. In FIG. 5*i*, a phase is shown in which the subsequent mail piece Pn+1 is removed from the stack. The desired values cited in the preceding thereby apply. The mail piece Pn+1 is thereby and subsequently transported by the transport device, similar to as has been shown for the mail piece Pn in FIG. 5*f*. The stack is then additionally separated further, wherein the leading edge of a subsequent mail piece Pn+2 is transported up to the sensor S2 by the separation device. (FIG. 5*j*, FIG. 11).

Figure 11:
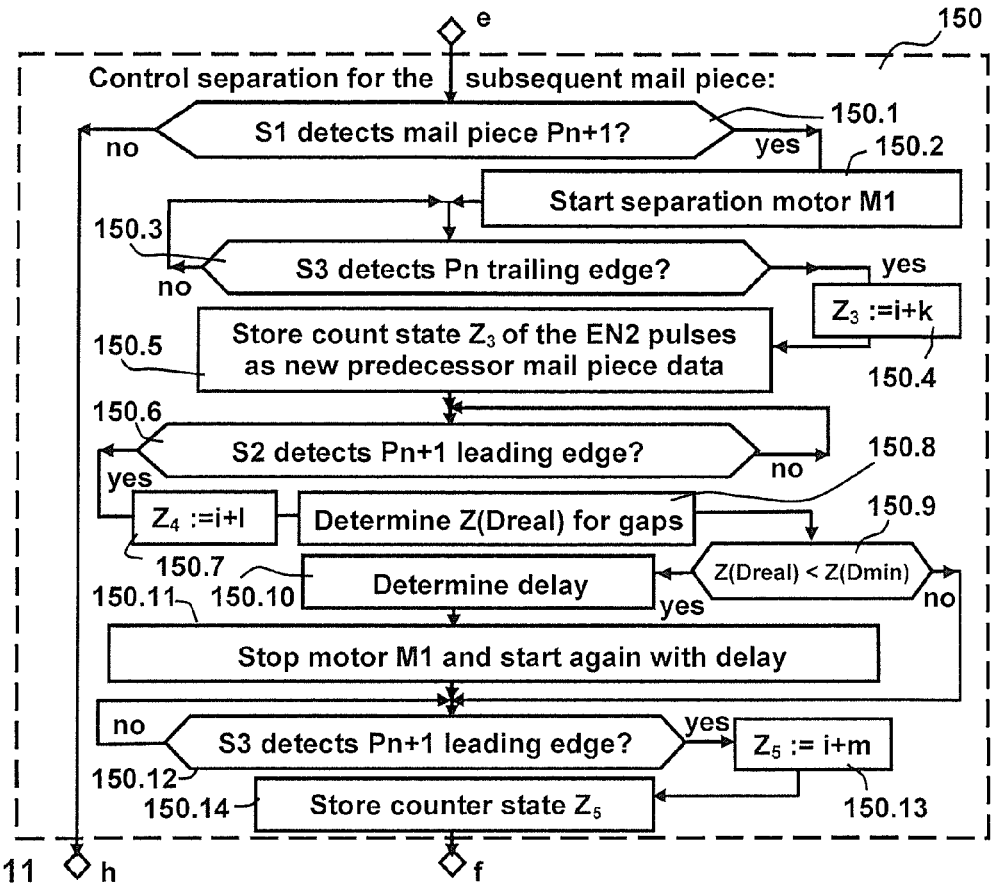

In FIG. 11, the routine 150 is shown with which the separation for the following mail piece is controlled in the event that, in the first query Step 150.1, the first sensor S1 detects a current mail piece Pn+1 to be separated which follows after the mail piece Pn with a clearance. However, if no current mail piece Pn+1 to be separated has been detected, a point h is reached. Given a present stack, or mail piece Pn+1 that is still currently to be separated, in a second step the separation motor M1 is started again or operated further with a respective preset rotation speed so that the automatically determined or, respectively, previously written desired value of the separation velocity in the feed station is reached and kept constant. In the following query Step 150.3, a check is made as to whether the third sensor S2 detects the trailing edge of the mail piece Pn (predecessor). If no, the workflow waits in a wait loop for the event that the trailing edge of the mail piece Pn (predecessor) is detected. A third count state $Z_3$ of the counter is reached for the encoder pulses of the encoder EN2. These data are then stored as new data of the preceding mail piece in Step 150.5.

In the following query Step 150.6 a check is made as to whether the second sensor S2 has already detected the leading edge of the current mail piece Pn+1 to be separated. If not, then the workflow waits in a wait look for the event. If yes, in Step 150.7 the fourth count state $Z_4$ of the counter for the encoder pulses of the encoder EN2 is determined, and a gap determination follows after this. The latter assumes that in Step 140.4 of the routine 140 (FIG. 10) a second count state $Z_2$ of the counter for the encoder pulses of the encoder EN2 has been stored which is associated with the event established in Step 140.2—that the second sensor has detected the trailing edge of the mail piece Pn. The current gap Dreal results from the count spacing $X=Z_4-Z_2$. In the following query Step 150.9 a check is made as to whether the determined count spacing (Dreal) is smaller than the minimum count spacing (Dmin), which corresponds to the gap between the mail pieces. If that is the case, the workflow branches to Step 150.10 in order to determine a delay duration in which the motor M1 (which is stopped in the subsequent Step 150.11) can be started again. If it is not the case that the count spacing Z(Dreal) is smaller than the minimum count spacing Z(Dmin) corresponding to the predetermined minimum gap between the mail pieces, then the workflow branches to Step 150.12 in order to wait for this and establish that the leading edge of the mail piece Pn+1 has arrived in the region of the third sensor S3. In Step 150.13, a fifth count state $Z_5$ of the counter for the encoder pulses of the encoder EN2 is determined, and this is stored in Step 150.14. The point f is subsequently reached.

Figure 12:
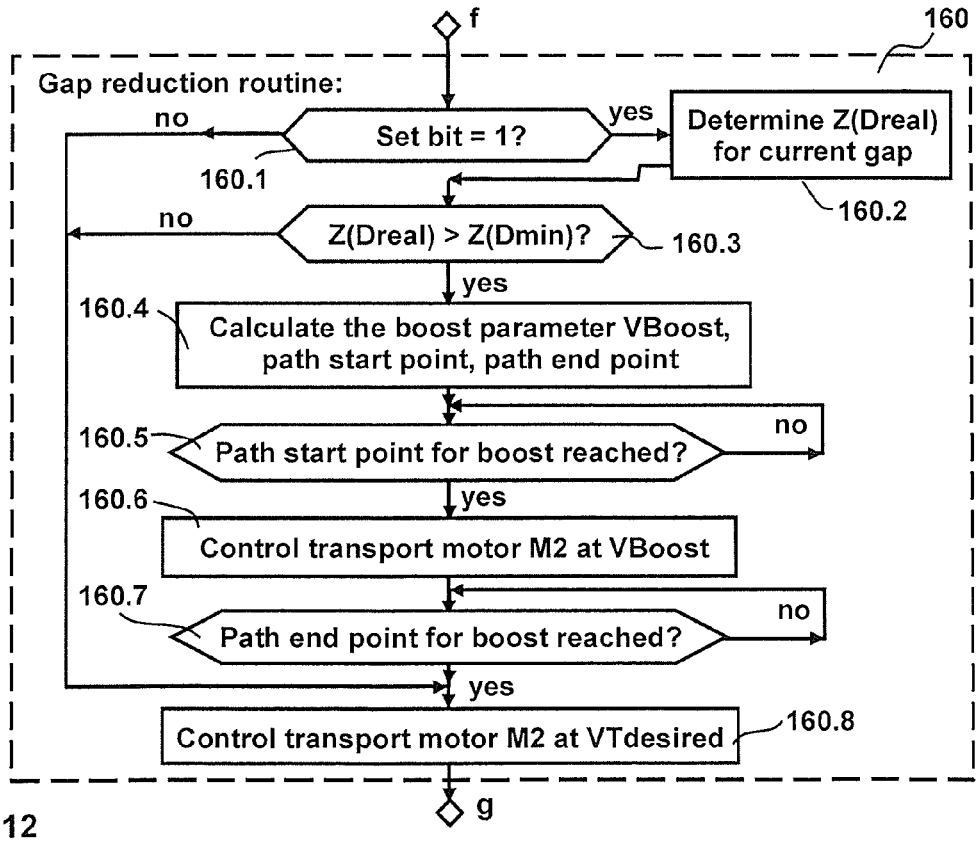

The gap reduction routine 160 us explained using FIG. 12. In a first query Step 160.1 a check is made as to whether a bit is set to a value of 1. The workflow branches to an eighth Step 160.8 if no bit is set to a value of 1. If a bit is set to a value of 1, though, an implementation of the gap reduction routine then takes place and a second Step 160.2 is reached in which a gap measurement is implemented with the participation of the third sensor S3, the principle of which has already been explained in FIG. 11 using the second sensor.

A query Step 160.3 is then reached in which a check is made as to whether the minimum count spacing Z(Dmin) is smaller than the count spacing Z(Dreal), wherein the minimum count spacing Z(Dmin) corresponds to the minimum path gap Dmin and count spacing Z(Dreal) corresponds to the currently measured gap Dreal between two successive mail pieces. If yes—thus if the minimum path gap has been exceeded—the boost parameters are then calculated by the processor in the following Step 160.4.

However, if the set minimum path gap Dmin is not smaller than the currently measured gap, the workflow then branches again to the eighth Step 160.8. After the boost parameters have been calculated by the processor, a query Step 160.5 is reached in which a check is made as to whether a precalculated path start point has been reached by the mail piece Pn+1. If that is the case (as was shown in FIG. 5*i*), the transport motor is controlled so that the calculated increased transport velocity VBoost is active given the transport of the currently separated mail piece Pn+1. However, if that is not the case, in a wait loop the workflow waits for the event that the path start point is reached by the mail piece Pn+1. The transport motor M2 of the transport device is controlled in Step 160.6 until it is established in a subsequent query Step 160.7 that a precalculated path end point has been reached by the mail piece Pn+1. However, if this is the case—as was shown in FIG. 5*j*—then the eighth Step 160.8 is reached in which the transport motor M2 of the transport device is controlled accordingly such that the desired transport velocity VTdesired is reached and kept constant. The workflow subsequently branches to the point g. If the current gap is too large, the set minimum path gap of approximately 60 mm between two successive mail pieces is achieved via the gap reduction routine 160 (FIG. 12).

In the standard mode, postcards (thin mail pieces) and standard letters (i.e. "normal" mail pieces of medium thickness) can be processed automatically. Only mail pieces of the same format may be present in a placed stack. In principle, letters of the same format but different thickness can be mixed if they have the same postage. That is the case for the standard letter used in Germany. The maximum dimensions of 5 mm×125 mm×235 mm apply for the standard letter. Upon power-up, a standard control is set automatically that operates with the lowest separation velocity $Vs_{desired}$=125 mm/s. All smaller formats and thickness up to 5 mm can also be processed with this setting without separation errors. Based on the longest dimension of the mail piece (letter length), the feed station can automatically differentiate whether a stack of postcards or, respectively, "thin" mail pieces or "normal" mail pieces of medium thickness (letters) are present and automatically adjust the control parameters of the drive motors differently. A measurement of the letter length takes place via the control unit with the aid of the third photoelectric barrier. A length L<L1=200 mm normally applies for postcards, and a length L≥L1=200 mm applies for "normal" mail pieces of medium thickness.

The separation velocity amounts to $Vs_{desired}$=125 mm/s for thin mail pieces, $Vs_{desired}$=160 mm/s for "normal" mail pieces of medium thickness, but $Vs_{desired}$=300 mm/s for thick mail pieces.

The transport velocity normally amounts to 320 mm/s and can be increased to 420 mm/s (boost transport velocity) or be reduced down to zero.

The mode for thick mail pieces must be set via the franking machine. For example, letters as of approximately 5 mm thickness are meant by "thick" mail pieces. There is no association with the letter length. Given a setting of "thick letters", letters of the same format but different thickness can likewise be mixed (for example approximately 5 mm to 10 mm) insofar as they have the same postage value. A mixing of thin and thick letters (thus 1 mm to 10 mm) is not permitted. Given a control of "thick letters", thin letter formats (most of all given short formats) can lead to separation errors. The setting of the "thick letters" function takes place via a control panel via user interface at the touchscreen of the franking machine. A change to thick mail pieces then takes place as needed via the franking machine, i.e. given very thick letters (for example the compact letter used in Germany, for which the maximum dimensions are 10 mm×125 mm×235) or given all mail pieces that are not to be processed or are difficult to process with the standard control. Given the setting of the operating mode for thick mail pieces, mail pieces of the DIN formats B4 through B6 or, respectively, C4 through C6 and all thickness are processed, but the set of the smaller formats is not always ensured.

In the non-seal mode, the minimum path gaps between two successive mail pieces are normally $\Delta s_{Dmin}$=60 mm. However, this minimum path gap can be reduced to $\Delta s_{Dmin}$=35 mm in order to increase the throughput to 65 mail pieces per minute.

In contrast to this, given closing of open envelopes a defined minimum duration is required so that the flap can be securely glued to the envelope. Therefore, the separation process for the respective following mail piece Pn+1 is halted if its leading edge reaches the region of the second sensor. The separation motor is started again with a delay, as arises from, the sub-program 150 (FIG. 11). The processor of the control unit uses a quartz-controlled clock pulse emitter (not shown) for deriving different time clocks. This minimum duration for the mail piece Pn whose flap has been glued down can thus be maintained. A minimum time gap which is independent of the transport velocities with which [the] transport motor of the feed station is operated thereby results between the successive mail pieces.

In the seal mode, the minimum time gaps are normally $\Delta t_D$=0.2 s for mail pieces with a length less than 280 mm. Those mail pieces are designated as Kompaktbrief and Standardbrief (compact letter and standard letter) by the Deutsche Post AG. However, these minimum time gaps can be increased automatically to $\Delta t_D$=0.9 s for mail pieces with a length of greater than 280 mm. Those mail pieces are designated as Maxibrief and Groβbrief (maxi-letter and large letter) by the Deutsche Post AG.

Although mail pieces and letters are discussed in the preceding examples, the invention can be used for other flat items that are stackable.

Although modifications and changes may be suggested by those skilled in the art, it is the intention of the inventor to embody within the patent warranted hereon all changes and modifications as reasonably and properly come within the scope of his contribution to the art.

I claim as my invention:

1. A feed station to feed flat items from an entrance of said feed station to an exit of said feed station, said feed station comprising, in succession, a pre-separation region, at said entrance a separation region, and a transport region that collectively form a transport path for said flat items, in a transport direction; to said exit and wherein:

the separation region a segment of the transport path beneath a stack of said flat items and between a first separation roller and a second separation roller driven by a motor of a separation device;

a first sensor situated at a start of the separation region that detects said stack of said flat items placed in the pre-separation region, and a second sensor situated at the start of the transport region;

said separation device comprising an encoder that emits an encoder signal that measures rotation imparted to said first and second separation rollers by said motor;

a control unit comprising a signal processor that receives signals of the sensors and the encoder, and configured to determine a position of each flat item in the separation region from all of said signals;

said control unit comprising a motor drive connected outputs thereof with said motor of the separation device; and said signal processor being configured to control the motor of the separation device to cause each flat item to be separated from the stack with a predetermined separation velocity; and to detect a gap in said transport path between a preceding, separated flat item and a subsequent flat item in said transport direction and to maintain a predetermined clearance from a leading edge of said subsequent flat item and a trailing edge of said preceding flat item by digital velocity regulation of said separation velocity, said leading edge and said trailing edge being determined from all of said signals, and to stop said motor of said separation device, and thus stop movement of said subsequent flat item through said separation region, if the gap between said leading edge of said subsequent item and said trailing edge of said preceding flat item is less than said predetermined clearance, and re-start said motor of said separation device when said gap returns to said predetermined clearance.

2. A feed station according to claim 1 wherein the predetermined distance is a path distance between the flat items following in immediate succession.

3. A feed station according to claim 1, wherein the processor is configured to automatically determine input variables and is connected with a memory means for the automatically determined input variables and additional manually entered input variables, such that the control unit controls the separation motor and the transport motor, wherein the control is based on a number of suitable desired velocity values or, respectively, machine-specific path and/or time values for the separation and transport of a flat item which are applied depending on the determined dimension and position of the flat item in the transport path.

4. A feed station according to claim 1, comprising in that: a third sensor arranged on the transport path in the transport region and wherein the control unit comprises a further motor drive connected at outputs thereof with a transport motor to drive a transport device in said transport region, and wherein said signal processor is configured to:

control the separation motor of the separation device so that a current gap that is too small is increased to a minimum gap Dmin, and control the transport motor so that a separated flat item is transported downstream in terms of the mail flow and supplied to said exit with a predetermined transport velocity, wherein the transport velocity is varied automatically before the feed depending on the stored data of a preceding separated flat item and on the position of the current flat item to be separated, such that a gap that is too large between the goods is reduced to a predetermined distance, and a predetermined throughput of flat items results.

5. A feed station according to claim 4, wherein:

the separation device comprises a first sensor device that includes the first sensor, and a first actuation device that kinematically couples the separation motor with the first separation roller and with the second separation roller with regard to their rotation, wherein the first sensor device includes a mount situated at an incline the first sensor is attached, to cause said first sensor to detect when a flat item is at the feed station entrance with a light beam traveling inclined at an angle $\alpha$ relative to the transport device in a region before the first separation roller; and the transport device comprises a transport device encoder, a second sensor device that includes the second sensor, and a third sensor device, and a second actuation device that kinematically couples a first transport roller and with a second transport roller of the transport device, with regard to their rotation, with said transport motor, and wherein the second sensor device and the third sensor device are situated in succession in the transport direction of the flat items.

6. A feed station according to claim 5, wherein each of the sensor devices comprises mounts for light sources and light collectors of a photoelectric barrier.

7. A feed station according to claim 5, wherein the separation rollers and transport rollers are each equipped with a free-running mechanism so as to be rotatable within a U-shaped frame and wherein the first actuation device for the separation rollers is situated at one side of the U-shaped frame and the second actuation device for the transport rollers is arranged at an opposite side of the U-shaped frame; and wherein the encoder of the separation device is arranged on an axle shaft of the drive motor of the separation device and the transport device encoder is arranged on an axle shaft of the drive motor of the transport device.

8. A feed station according to claim 5, wherein the drive motor of the separation device is a first direct current motor that is controlled by the control unit so that, in the standard mode, a first predetermined separation velocity is achieved at least given a first flat item removed from the stack; in that the drive motor of the transport device is a second direct current motor that is controlled by the control unit so that, in the standard mode, a first predetermined transport velocity is achieved at least given a first flat item removed from the stack, wherein the first transport velocity is greater than the first separation velocity; in that the length of the transported flat item is determined by the control unit using the encoder pulses of a second encoder, wherein, for each additional flat item removed from the stack, a third separation velocity is predetermined if a switch of the feed station to a thickness mode has taken place by means of the subsequent mail processing apparatus, wherein the third separation velocity is greater than the second separation velocity.

9. A feed station according to claim 8, wherein the standard mode is selected automatically or in that the thickness mode is selected manually if the thickness of the transported flat item exceeds a predetermined thickness value; in that the third predetermined separation velocity is lower than the first predetermined transport velocity and greater than the second predetermined separation velocity; and in that the second predetermined separation velocity is greater than the first predetermined separation velocity.

10. A feed station according to claim 1, wherein the separation device has a sluice formed in multiple stages for a flat item, wherein at least one sluice is provided in the separation region.

11. A feed station according to claim 10, comprising at least one pre-separation finger attached to a pre-separation plate.

* * * * *